US011808503B2

(12) United States Patent
Hurst

(10) Patent No.: US 11,808,503 B2
(45) Date of Patent: Nov. 7, 2023

(54) HEAT ENGINES AND HEAT PUMPS WITH SEPARATORS AND DISPLACERS

(71) Applicant: Ronald Alan Hurst, Niagara Falls (CA)

(72) Inventor: Ronald Alan Hurst, Niagara Falls (CA)

( * ) Notice: Subject to any disclaimer, the term of this patent is extended or adjusted under 35 U.S.C. 154(b) by 0 days.

(21) Appl. No.: 17/896,898

(22) Filed: Aug. 26, 2022

(65) Prior Publication Data

US 2023/0003424 A1 Jan. 5, 2023

Related U.S. Application Data

(62) Division of application No. 17/698,450, filed on Mar. 18, 2022, now Pat. No. 11,454,426.
(Continued)

(51) Int. Cl.

| | |
|---|---|
| ***F25B 9/14*** | (2006.01) |
| ***F02G 1/055*** | (2006.01) |
| ***F25B 30/02*** | (2006.01) |

(52) U.S. Cl.
CPC ..... *F25B 9/14* (2013.01); *F02G 1/055* (2013.01); *F25B 30/02* (2013.01)

(58) Field of Classification Search
CPC ..... F25B 9/14; F25B 30/02; F02G 1/055
See application file for complete search history.

(56) References Cited

U.S. PATENT DOCUMENTS 3,698,182 A * 10/1972 Knoos ..... F02G 1/044 60/525
3,782,859 A 1/1974 Schuman
(Continued)

FOREIGN PATENT DOCUMENTS

DE 19742660 A1 6/1999
JP 2015132246 A 7/2015

OTHER PUBLICATIONS

Yanmar, "Gas-Engine Heat Pump (Ghp)|Energy Systems|Yanmar." Yanmar, 2021, Accessed on Mar. 31, 2022 qt URL: https://www.yanmar.com/global/energy/ghp/.
(Continued)

*Primary Examiner* — Shafiq Mian
(74) *Attorney, Agent, or Firm* — Perry + Currier Inc.

(57) ABSTRACT

An apparatus, which may be operated as a heat engine and/or a heat pump, includes moveable separators at a cold side and/or moveable separators at a hot side. Each separator divides a volume into two smaller volumes. Working fluid may be sequentially filled and emptied from volumes between the separators. The separators may move to maintain uniform pressure in the volumes. Hot-side separators may allow for near adiabatic compression/expansion of working fluid. Cold-side separators may allow for near adiabatic expansion/compression of working fluid. Two displacers are positioned between the cold-side separators and the hot-side separators. The displacers are independently actuatable to force working fluid into and out of the volumes between separators and into and out of a variable intermediate volume between the displacers. Heat exchangers, including a warming heat exchanger, are provided to heat, cool, and warm working fluid as it flows between separated volumes and the intermediate volume.

21 Claims, 25 Drawing Sheets

Related U.S. Application Data

(60) Provisional application No. 63/163,714, filed on Mar. 19, 2021.

(56) References Cited

U.S. PATENT DOCUMENTS

| | | | | | |
|---|---|---|---|---|---|
| 4,078,389 | A | | 3/1978 | Bamberg | |
| 4,183,214 | A | * | 1/1980 | Beale | F02G 1/0435 60/520 |
| 4,195,482 | A | * | 4/1980 | Moloney | F02G 1/043 60/517 |
| 4,455,826 | A | * | 6/1984 | Knoos | F02G 1/0445 60/641.15 |
| 4,498,295 | A | * | 2/1985 | Knoos | F02G 1/04 60/517 |
| 4,870,821 | A | | 10/1989 | Harada et al. | |
| 4,885,017 | A | * | 12/1989 | Fleischmann | F25B 9/14 60/526 |
| 4,945,726 | A | | 8/1990 | Beale | |
| 5,195,320 | A | * | 3/1993 | Kushnir | F25B 9/14 277/411 |
| 5,301,506 | A | | 4/1994 | Pettingill | |
| 5,562,079 | A | | 10/1996 | Gray, Jr. | |
| 7,021,054 | B2 | | 4/2006 | Alderson et al. | |
| 7,124,585 | B2 | | 10/2006 | Kim et al. | |
| 9,109,534 | B2 | | 8/2015 | Song | |
| 9,435,291 | B2 | | 9/2016 | Klassen | |
| 9,677,794 | B2 | * | 6/2017 | Hofbauer | F25B 30/02 |
| 10,087,883 | B2 | | 10/2018 | Holsapple | |
| 11,047,335 | B2 | | 6/2021 | Kleinwachter | |
| 2010/0064681 | A1 | | 3/2010 | Yegge | |
| 2011/0314805 | A1 | | 12/2011 | Seale et al. | |
| 2018/0119638 | A1 | | 5/2018 | Kleinwachter | |
| 2018/0371959 | A1 | | 12/2018 | Ebert et al. | |

OTHER PUBLICATIONS

Kurylo, Konrad et al "A comparative study on electric and gas engine heat pump." E3S Web of Conferences. vol. 137. EDP Sciences, 2019.

* cited by examiner

HEAT ENGINES AND HEAT PUMPS WITH SEPARATORS AND DISPLACERS

CROSS-REFERENCE TO RELATED APPLICATIONS

This application is a divisional application of U.S. patent application Ser. No. 17/698,450, filed Mar. 18, 2022, which claims priority to and the benefit of U.S. provisional patent application Ser. No. 63/163,714, filed Mar. 19, 2021, and incorporated herein by reference.

FIELD

The present disclosure relates to heat pumps, heat engines, and related apparatuses.

BACKGROUND

Various heat sources can be used to provide heating, cooling and mechanical or electrical power to where it is desired such as a residential, commercial or industrial buildings or equipment. Such heat sources may include solar, gas, oil products, renewable biomass, landfill gas, coal, geothermal, industrial waste heat, and so on. These heat sources can be used as a heat input for heat pumps and heat engines. Such heat energy is widely available. For instance, a significant portion of the energy released in a thermodynamic cycle power plant, such as a fossil fuel or nuclear power plant, is released as heat, not electricity. This excess heat is discharged as waste and generally serves no practical purpose.

SUMMARY

According to various embodiments of the present disclosure, an apparatus includes a vessel to contain a working fluid, the vessel including a hot side and a cold side in fluid communication with the hot side via a flow path and a displacer positioned within the vessel. The displacer is moveable to the hot side of the vessel to displace working fluid from the hot side into the cold side via the flow path. The displacer moveable to the cold side of the vessel to displace working fluid from the cold side into the hot side via the flow path. The apparatus further includes a separator positioned within the cold side of the vessel to divide the cold side into separate volumes including a first volume on a side of the separator closer to the displacer and a second volume on an opposite side of the separator further from the displacer. The separator is moveable to selectively communicate the first volume to the flow path and the second volume to the flow path to allow the first and second volumes to have different temperatures of working fluid at the cold side of the vessel.

According to further embodiments of the present disclosure, an apparatus includes a vessel to contain a working fluid, the vessel including a hot side and a cold side in fluid communication with the hot side via a flow path and a displacer positioned within the vessel. The displacer is moveable to the hot side of the vessel to displace working fluid from the hot side into the cold side via the flow path, and the displacer moveable to the cold side of the vessel to displace working fluid from the cold side into the hot side via the flow path. The apparatus further includes a separator positioned within the hot side of the vessel to divide the hot side into separate volumes including a third volume on a side of the separator closer to the displacer and a fourth volume on an opposite side of the separator further from the displacer. The separator is moveable to selectively communicate the third volume to the flow path and the fourth volume to the flow path to allow the third and fourth volumes to have different temperatures of working fluid at the hot side of the vessel.

According to further embodiments of the present disclosure, a method of using heat to provide cooling includes applying heat at a hot volume, where the hot volume and a series of cold-side volumes form a closed system containing working fluid. The method further includes sequentially filling the series of cold-side volumes with working fluid received from the hot volume, where each cold-side volume expands as the cold-side volume is filled with working fluid, and where the cold-side volumes are equalized in pressure during filling. The method further includes reversely sequentially emptying the series of cold-side volumes of working fluid to the hot volume, where each cold-side volume contracts as the cold-side volume is emptied of working fluid, wherein the cold-side volumes are equalized in pressure during emptying.

DETAILED DESCRIPTION

A heat pump is often a heat engine, such as a Stirling engine, run in the reverse direction requiring the addition of external power to operate. The techniques described herein use a source of heat energy in a unique way to provide cooling while being capable of providing heating through enhanced cogeneration and power simultaneously.

The present disclosure concerns apparatuses, which may be termed heat engines and/or heat pumps, which may be used to provide heating, cooling and/or produce work. An apparatus may include separators at the cold side, hot side, or both hot and cold sides to cause a working fluid to undergo near adiabatic expansion or compression, so as to improve efficiency of the apparatus's cooling, heating, and power generation. An apparatus may include primary and secondary displacers that provide for a warming volume therebetween, so that cold working fluid may be warmed and then deposited in the warming volume prior to being sent to the hot side. Further improvements and advantages of the techniques discussed herein will be apparent from the detailed description below.

Figure 1:
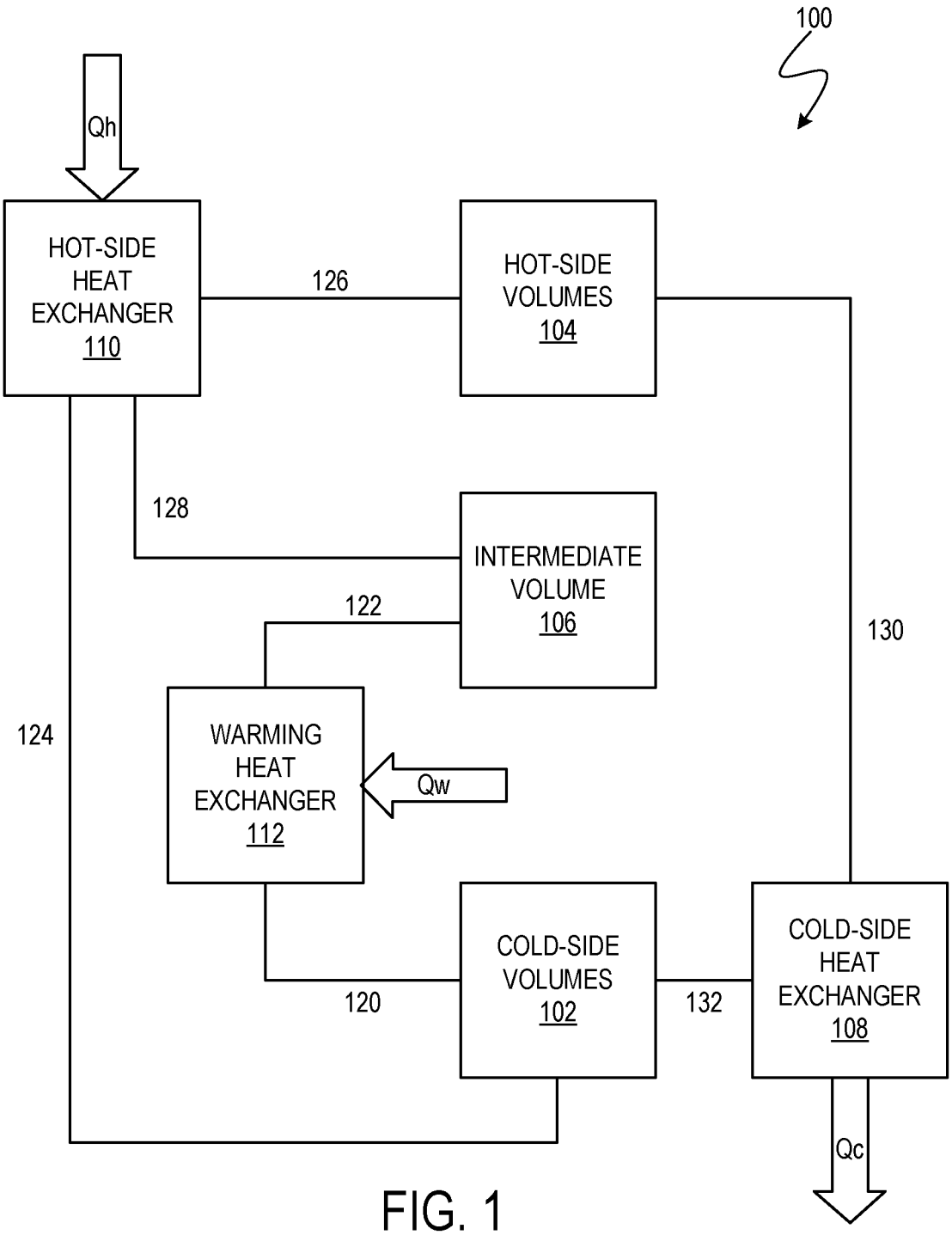
FIG. 1 is a schematic diagram of an example apparatus.

FIG. 1 shows an example apparatus 100. The apparatus 100 includes cold-side volumes 102, hot-side volumes 104, an intermediate volume 106, a cold-side heat exchanger 108, a hot-side heat exchanger 110, and a warming heat exchanger 112.

The apparatus 100 may use heat to provide cooling. In addition or alternatively, the apparatus 100 may exploit a temperature difference to perform work. The hot-side heat exchanger 110 may receive heat input Qh from a heat source, and the cold-side heat exchanger 108 may provide heat output Qc to a cold sink. The warming heat exchanger 112 may receive warm input Qw from a warming source that may have a temperature lower than the temperature of the heat source. In various examples, the warming source may be cooler than the cold sink, as will be discussed. Such examples may provide for enhanced cooling capacity. In other examples, the warming source may have a temperature between the temperatures of the heat source and the cold sink. In such examples, enhanced power may be extracted from the apparatus 100.

The apparatus 100 is a closed system that contains a working fluid. The apparatus 100 may be operated according to an example cycle that will be described in detail below. The working fluid may include a gas, such as air, pressurized air, helium, 3He, hydrogen, nitrogen, or similar. The heat exchangers 108, 110, 112 may each use an appropriate heat-exchange fluid, such as air, combustion gasses, water, glycol solution, refrigerant, salt solution, oil, etc. to exchange heat with the working fluid as will be discussed.

The components 102-112 of the apparatus 100 are connected by flow paths 120-132 for flow of the working fluid. The flow paths 120-132 may include pipes, tubes, conduits, or the structures of the components 102-112 themselves. The components 102-112 may have input and output ports directly connected.

The flow paths 120-132 may be opened and closed mechanically to respectively allow and block flow of working fluid. The flow paths 120-132 may be controlled is this way by relative pressures of the working fluid, valves, or by movement or actuation of subcomponents of the components 102-112, as will be discussed in detail below.

The cold side volumes 102 are connected to the warming heat exchanger 112 by a flow path 120, which provides for flow of working fluid from the cold-side volumes 102 to the warming heat exchanger 112.

The warming heat exchanger 112 is connected to the intermediate volume 106 by a flow path 122, which provides for flow of working fluid from the warming heat exchanger 112 to the intermediate volume 106.

Working fluid may flow from the cold-side volumes 102, through the warming heat exchanger 112, and into the intermediate volume 106, via the flow paths 120, 122. Working fluid may be warmed by the warming heat exchanger 112 as it flows from the cold-side volumes 102 to the intermediate volume 106.

The cold side volumes 102 are also connected to the hot-side heat exchanger 110 by a flow path 124, which provides for flow of working fluid from the cold-side volumes 102 to the hot-side heat exchanger 110.

The hot-side heat exchanger 110 is connected to the hot-side volumes 104 by a flow path 126, which provides for flow of working fluid from the hot-side heat exchanger 110 to the hot-side volumes 104.

Working fluid may flow from the cold-side volumes 102, through the hot-side heat exchanger 110, and into the hot-side volumes 104, via the flow paths 124, 126. Working fluid may be heated by the hot-side heat exchanger 110 as it flows from the cold-side volumes 102 to the hot-side volumes 104.

The intermediate volume 106 is connected to the hot-side heat exchanger 110 by a flow path 128, which provides for flow of working fluid from the intermediate volume 106 to the hot-side heat exchanger 110.

Working fluid may flow from the intermediate volume 106, through the hot-side heat exchanger 110, and into the hot-side volumes 104, via the flow paths 128, 126. Working fluid may be heated by the hot-side heat exchanger 110 as it flows from the intermediate volume 106 to the hot-side volumes 104.

The hot-side volumes 104 are connected to the cold-side heat exchanger 108 by a flow path 130, which provides for flow of working fluid from the hot-side volumes 104 to the cold-side heat exchanger 108.

The cold-side heat exchanger 108 is connected to the cold-side volumes 102 by a flow path 132, which provides for flow of working fluid from the cold-side heat exchanger 108 to the cold-side volumes 102.

Working fluid may flow from the hot-side volumes 104, through the cold-side heat exchanger 108, and into the cold-side volumes 102, via the flow paths 130, 132. Working fluid may be cooled by the cold-side heat exchanger 108 as it flows from the hot-side volumes 104 to the cold-side volumes 102.

The cold-side volumes 102 are configured with a movable separator to selectively communicate each cold-side volume to the flow paths 120, 124, 132. The movable separator allows the cold-side volumes 102 to sequentially empty or fill, as will be discussed in detail below. Any suitable number of cold-side volumes 102 may be provided by a respective number of separators. Sequential filling and emptying of the cold-side volumes 102 causes the total volume of working fluid present in the cold-side volumes 102 to respectively increase and decrease.

Note that the terms "empty" and "fill" and like terms are not limited to complete emptying or filling. These terms are used herein to denote partial or complete emptying or filling, as will be readily apparent from context. Further note that the term "complete" is used for sake of convenience. "Complete" and comparable terms allow for some working fluid to remain after completely emptying a volume and allow for some working fluid to be absent after completely filling a volume. The terminology "empty," "fill," and "complete" are used for sake of convenience and to aid understanding, and the person of ordinary skill in the art will understand their meaning given a particular context.

Likewise, the hot-side volumes 104 may be configured with a movable separator to selectively communicate each hot-side volume to the flow paths 126, 130. The movable separator allows the hot-side volumes 104 to sequentially empty or fill, as will be discussed in detail below. Any suitable number of hot-side volumes 104 may be provided by a respective number of separators. Sequential filling and emptying of the hot-side volumes 104 causes the total volume of working fluid present in the hot-side volumes 104 to respectively increase and decrease.

The intermediate volume 106 expands and contracts as working fluid enters and exits the intermediate volume 106.

The heat exchangers 108, 110, 112 physically separate the working fluid from fluids that transfer heat with the working fluid.

With reference to FIGS. 2A-2D, an example mode of operation of the apparatus 100 that realizes a thermodynamic cycle for the working fluid will now be discussed. The cycle will be described as a sequence of stages beginning with most or all of the working fluid filling the cold-side volumes 102 and being at a cold temperature.

Note that the arrows shown for the flow paths 120-132 generally indicate direction of flow of working fluid according to this example mode of operation of the apparatus 100. Flow of working fluid opposite the arrows and opposite what is described in this example may be used in other example modes of operation.

Figure 2A:
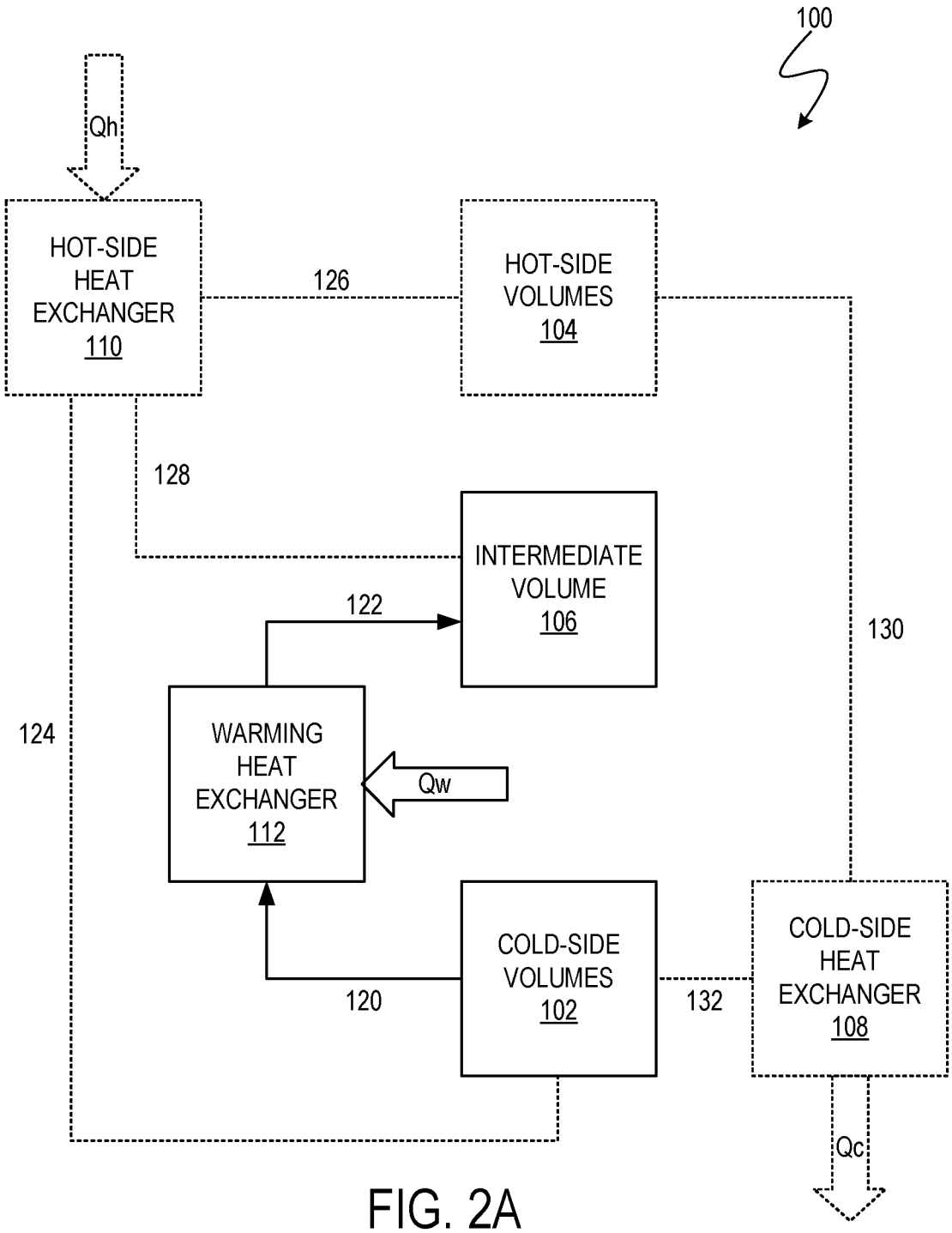
FIG. 2A is a schematic diagram of the apparatus of FIG. 1 during a warming stage of a thermodynamic cycle.

As shown in FIG. 2A, during a warming stage, working fluid sequentially empties from the cold-side volumes 102, flows through the warming heat exchanger 112 and into the intermediate volume 106, via the flow paths 120, 122. The working fluid is warmed as is passes through the warming heat exchanger 112 by warm input Qw. The cold-side volumes 102 contract and the intermediate volume 106 expands to receive the working fluid. Some working fluid may remain in the cold-side volumes 102.

Figure 2B:
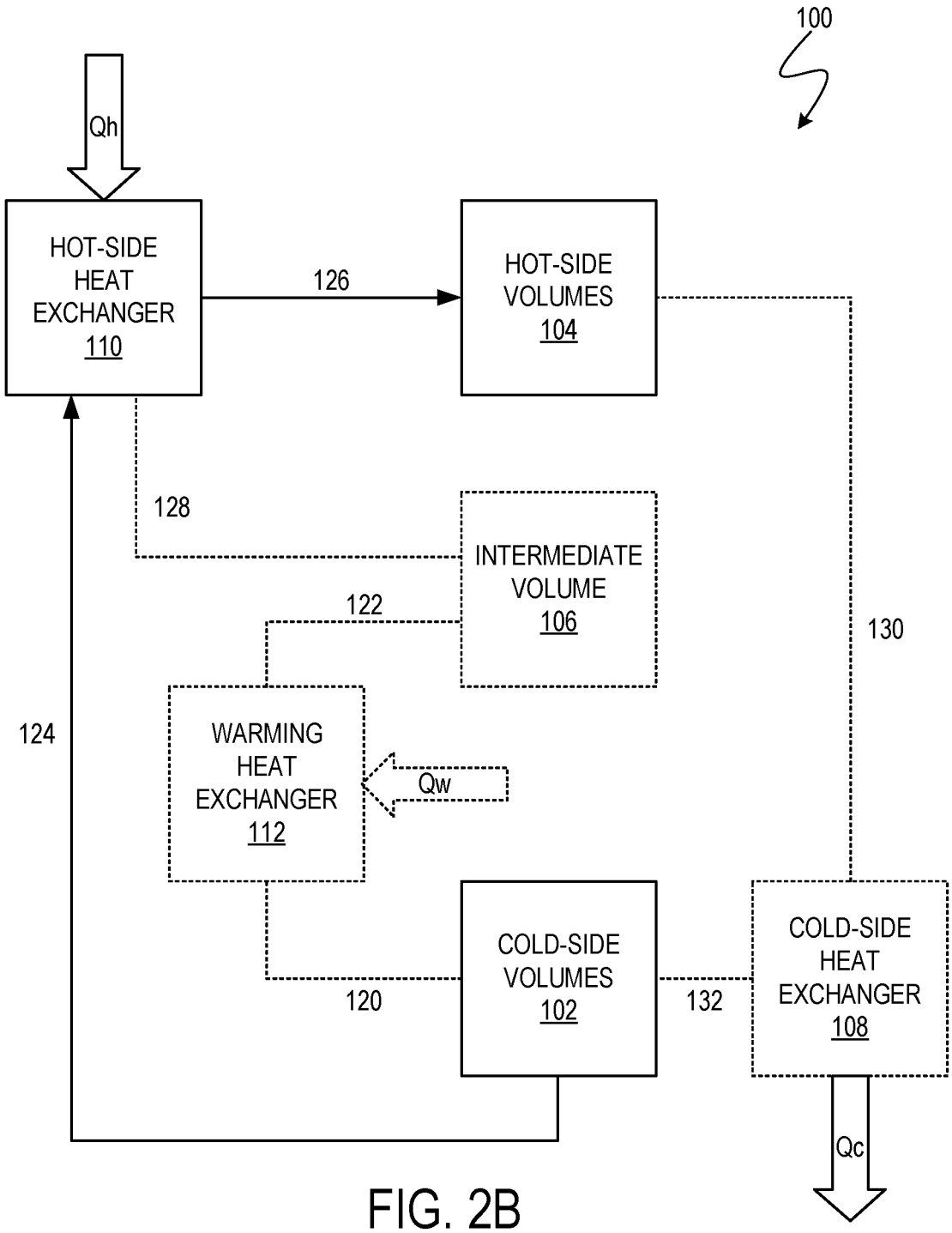
FIG. 2B is a schematic diagram of the apparatus of FIG. 1 during a heating stage of the thermodynamic cycle.

As shown in FIG. 2B, during a heating stage, working fluid continues to sequentially empty from the cold-side volumes 102, flows through the hot-side heat exchanger 110 and into the hot-side volumes 104, via the flow paths 124, 126. The working fluid is heated as it passes through the hot-side heat exchanger 110 by heat input Qh. The cold-side volumes 102 continue to contract and the hot-side volumes 104 sequentially fill to receive the working fluid. The hot-side volumes 104 may undergo near adiabatic compression of working fluid that further heats the hot-side volumes 104, potentially to a temperature greater than the heat source. At the end of this stage, most or all of the working fluid has been emptied from the cold-side volumes 102.

Figure 2C:
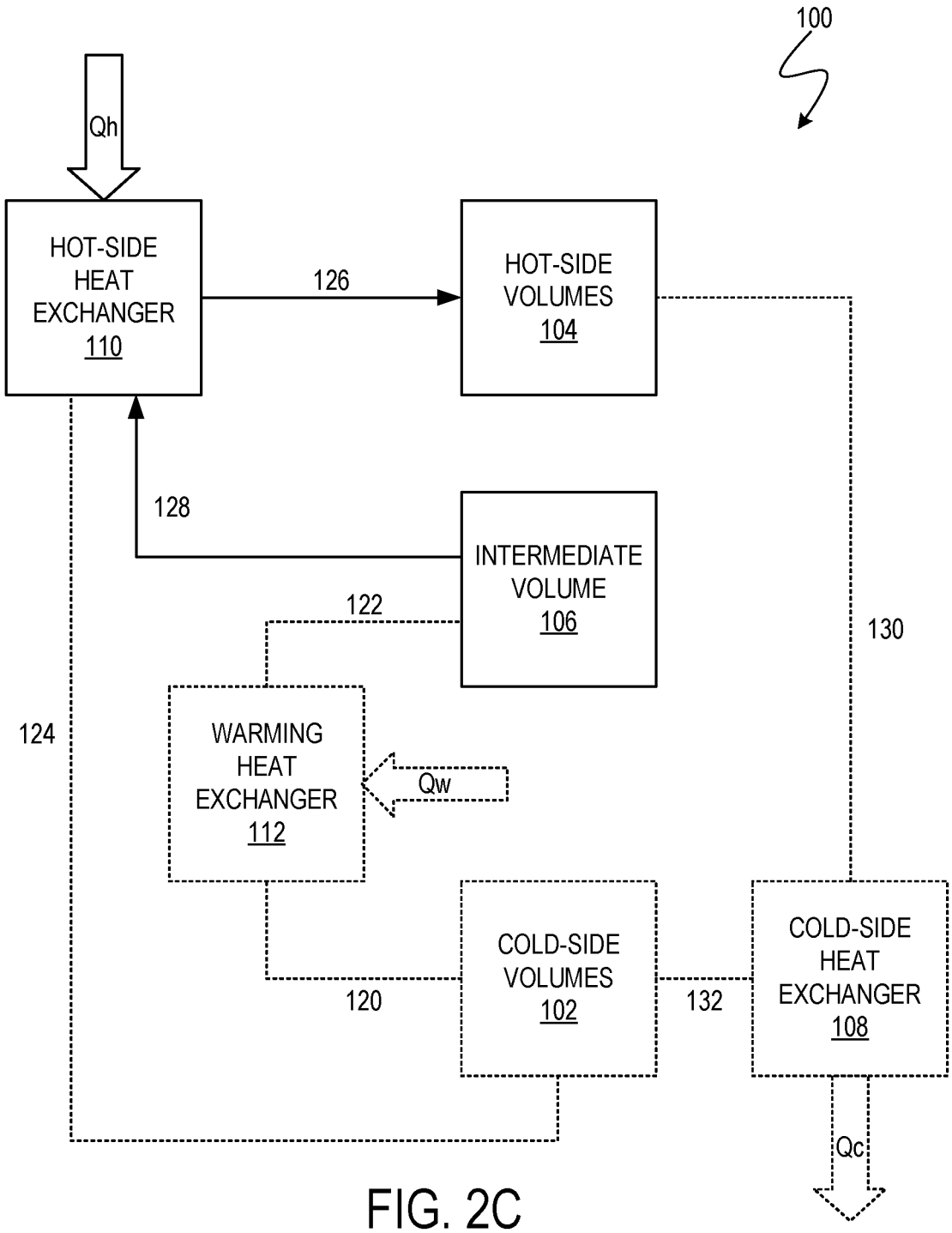
FIG. 2C is a schematic diagram of the apparatus of FIG. 1 during a continued heating stage of the thermodynamic cycle.

As shown in FIG. 2C, during a continued heating stage, working fluid empties from the intermediate volume 106, flows through the hot-side heat exchanger 110 and into the hot-side volumes 104, via the flow paths 128, 126. The working fluid is heated as it passes through the hot-side heat exchanger 110 by heat input Qh. The intermediate volume 106 contracts and the hot-side volumes 104 continue to sequentially fill to receive the working fluid. At the end of this stage, hot-side volumes 104 are completely full.

Figure 2D:
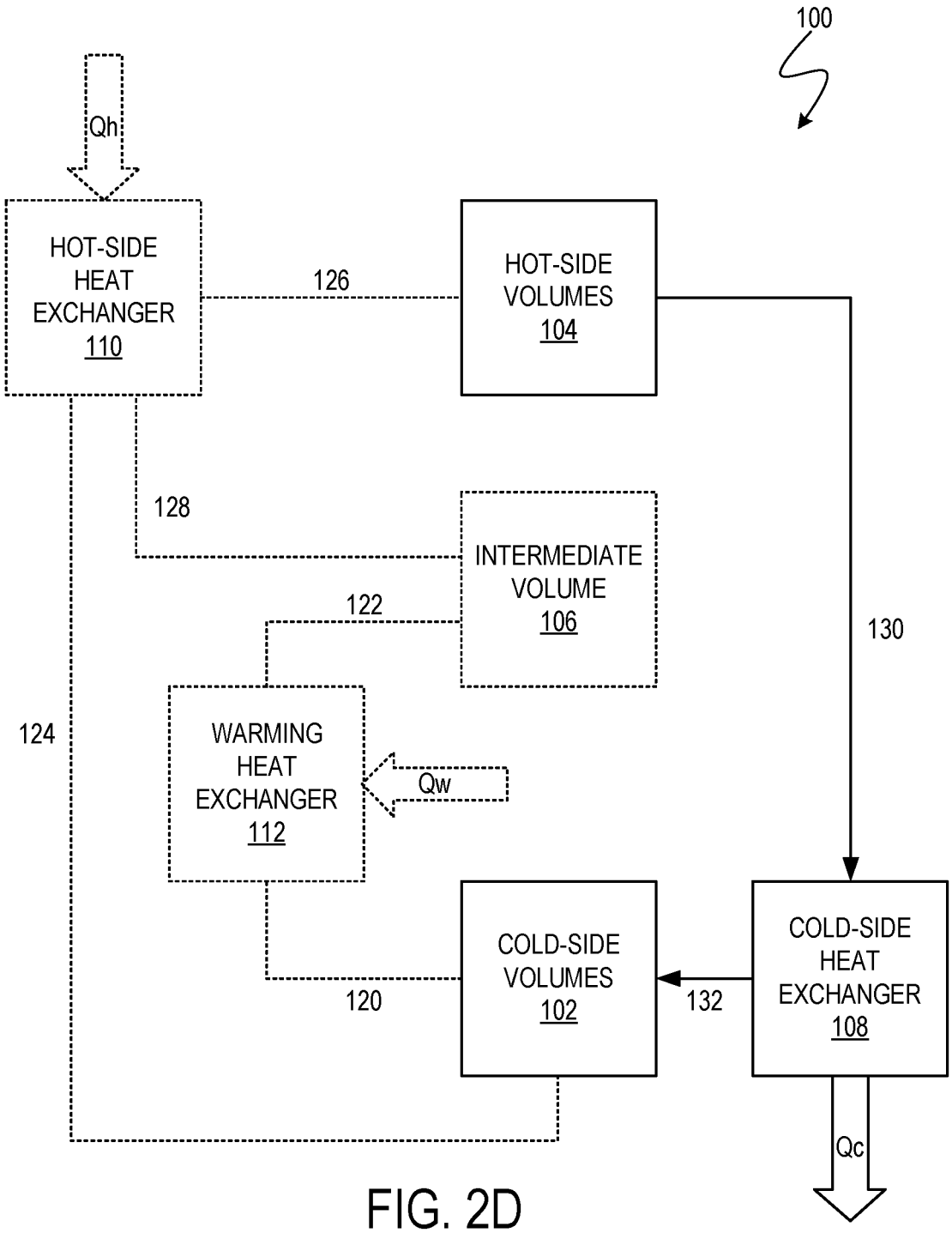
FIG. 2D is a schematic diagram of the apparatus of FIG. 1 during a cooling stage of the thermodynamic cycle.

As shown in FIG. 2D, during a cooling stage, working fluid sequentially empties from the hot-side volumes 104, flows through the cold-side heat exchanger 108 and into the cold-side volumes 102, via the flow paths 130, 132. The working fluid is cooled as it passes through the cold-side heat exchanger 108 rejecting heat as heat output Qc. The hot-side volumes 104 contract and the cold-side volumes 102 sequentially fill to receive the working fluid. The cold-side volumes 102 may undergo near adiabatic expansion of working fluid that further cools the cold-side volumes 102, potentially to a temperature lower than the cold sink, which may allow the warming heat exchanger 112 to use a temperature lower than the cold sink temperature of the cold-side heat exchanger 108. At the end of this stage, most or all of the working fluid has been emptied from the hot-side volumes 104 and cold-side volumes 102 are completely full.

After the cooling stage (FIG. 2D), the warming stage (FIG. 2A) may be performed and the cycle repeated. The cycle may be continually repeated to provide cooling to a space via heat input Qw. The cycle may additionally or alternatively perform work by allowing a boundary of the closed system to move in response to changes in working fluid pressure, as will be discussed in detail below.

Note that the stages discussed above may be discrete in that, as working fluid flows during a particular stage, working fluid is prevented from flowing to effect other stages. That is, each stage may provide flow to effect the stage while preventing flow of working fluid not related to the stage.

Figure 3:
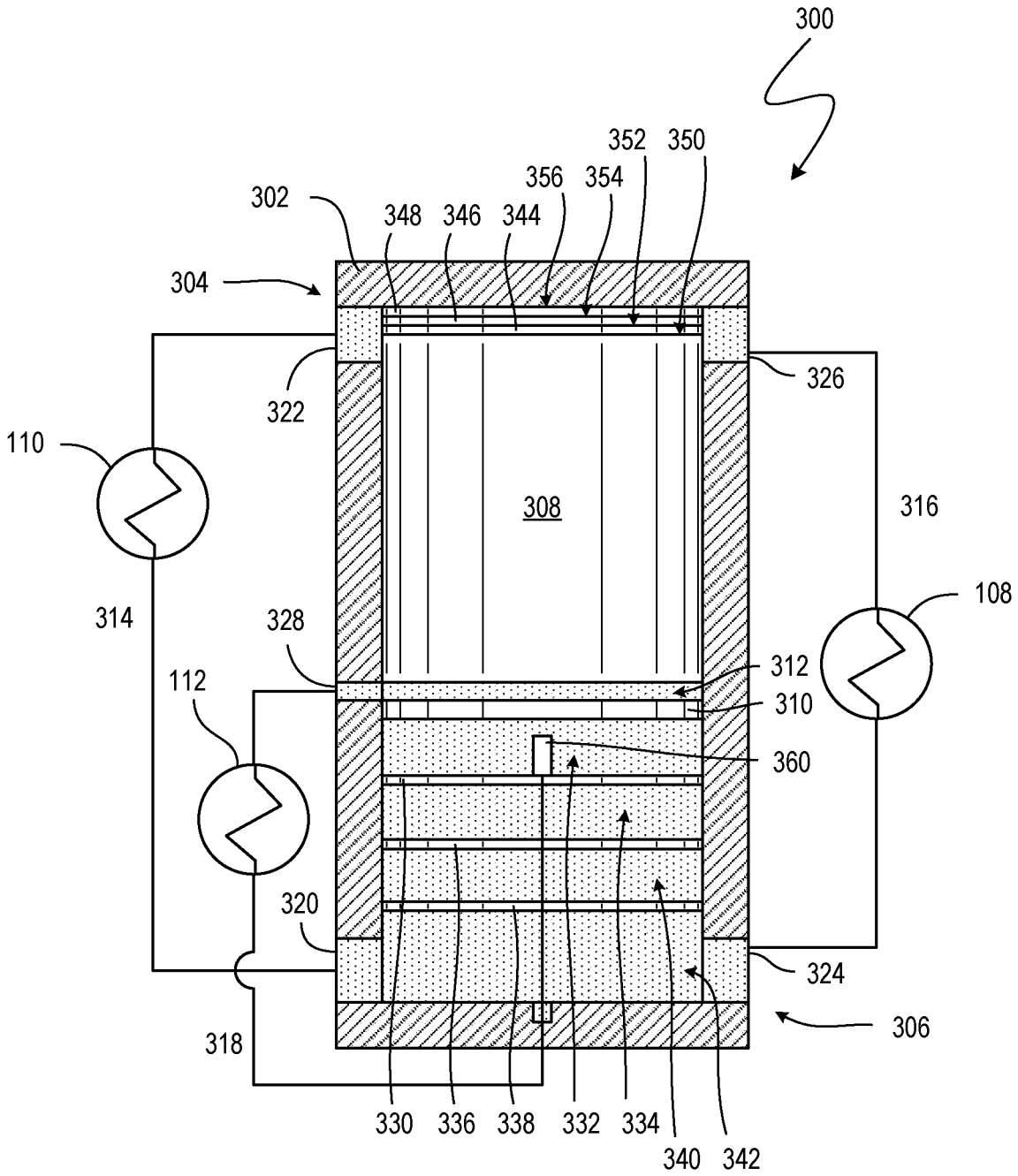
FIG. 3 is a cross-sectional side view an example apparatus with moveable separators.

FIG. 3 shows another example apparatus 300. The apparatus 300 may be considered thermodynamically equivalent to the apparatus 100. The discussion above for the apparatus 100 may be referenced for details of components with similar reference numerals and/or terminology. The discussion below concerning the mechanics of the apparatus 300 may be referenced to aid understanding of the apparatus 100.

The apparatus 300 includes a vessel 302 having a hot side 304 and a cold side 306. The vessel 302 may include an enclosed hollow cylindrical body. The hot side 304 may include a variable volume for working fluid. The cold side 306 may include a variable volume for working fluid.

The apparatus 300 incudes a primary displacer 308 positioned within the vessel 302 between the hot side 304 and the cold side 306. The primary displacer 308 is moveable and may reciprocate between the hot side 304 and the cold side 306. The primary displacer 308 may include a piston.

The apparatus 300 may further include a secondary displacer 310 moveably positioned within the vessel 302 and situated between the primary displacer 308 and the cold side 306. The secondary displacer 310 and the primary displacer 308 may enclose an intermediate volume 312 therebetween. The secondary displacer 310 may include a piston.

The apparatus 300 may include a cold-side heat exchanger 108, a hot-side heat exchanger 110, and a warming heat exchanger 112. The cold-side heat exchanger 108 may be provided with a cold sink, such as a cold flowing fluid, to cool the working fluid. The hot-side heat exchanger 110 may be provided with a heat source, such as a hot flowing fluid, to heat the working fluid. The warming heat exchanger 112 may be provided with a heat source, such as a flowing fluid that is above the temperature of the coldest fluid being warmed, to warm the working fluid.

The apparatus 300 may further include a hot-cold flow path between the hot side 304 and the cold side 306 to provide fluid communication for the working fluid to flow between the hot side 304 and the cold side 306. In this example, the hot-cold flow path is provided by separate heating and cooling flow paths 314, 316 to separately heat and cool working fluid as it is moved between the hot side 304 and the cold side 306 by way of movement of the primary displacer 308 and the secondary displacer 310. In other examples, the hot-cold flow path may be a single flow path through which hot and cool working fluid flows at different times. In still other examples, the hot-cold flow path may include separate flow paths that share a common portion, i.e., partially overlapping flow paths. A warming flow path 318 may also be provided to warm and heat the working fluid as it is displaced to and from the intermediate volume 312 between the displacers 308, 310.

The heating flow path 314 connects the cold side 306 to the hot side 304 through the hot-side heat exchanger 110. A port 320 at the cold side 306 and a port 322 at the hot side 304 may provide fluid communication via the heating flow path 314.

The cooling flow path 316 connects the hot side 304 to the cold side 306 through the cold-side heat exchanger 108. A port 324 at the cold side 306 and a port 326 at the hot side 304 may provide fluid communication via the cooling flow path 316.

The warming flow path 318 connects the cold side 306 to the intermediate volume 312 between the displacers 308, 310 through the warming exchanger 112. The port 360 at the cold side 306 and a port 328 at the intermediate volume 312 may provide fluid communication via the warming flow path 318.

The ports 320-328 may be provided through the wall of the vessel 302 and may take other forms and positions than described. Ports 320-328 may be fully or partially shared among suitable flow paths 314, 316, 318.

The apparatus 300 further includes a cold-side separator 330 positioned within the cold side 306 of the vessel 302 to divide the cold side 306 into separate volumes, such as first and second volumes 332, 334. The first volume 332 is located on a side of the separator 330 closer to the displacers 308, 310. The second volume 334 is located on an opposite side of the separator 330 further from the displacers 308, 310. Any suitable number of cold-side separators 330 may be provided in a series arrangement to divide the cold side 306 into a corresponding number of volumes. In the example depicted, three separators 330, 336, 338 provide four separate volumes 332, 334, 340, 342. It should be reality apparent that a series of N cold-side separators provides N+1 separate volumes to the cold side 306. In other examples, one, two, four, eight, or twelve separators are provided.

Each separator 330, 336, 338 may include a rigid plate that is slidable within the hollow space defined by the vessel 302. The rigidity should be sufficient to prevent the separator 330, 336, 338 from deforming to a degree that would impede the separation of the respective volumes and the movement of the separator 330, 336, 338. The separators 330, 336, 338 may be disc-shaped to conform to a cylindrical hollow space defined by the vessel 302

The separator 330 is moveable to selectively communicate the first volume 332 and the second volume 334 to the heating flow path 314, the cooling flow path 316, and the warming flow path 318. The ports 320, 324 may be positioned at an end of the cold side 306 furthest from the displacers 308, 310. The ports 320, 324 are positioned to sequentially and fill and empty the volumes 332, 334, 340, 342 between the separators 330, 336, 338. It should be readily apparent that the first volume 332 fills before the second volume 334 and empties after the second volume 334, when emptying to the hot side, as governed by movement of the separator with respect to the ports 320, 324. When emptying the cold side volumes to the intermediate volume, however, port 360 is used to empty, transfer, first volume 332 before the second volume 334.

The moveable separators 330, 336, 338 prevent the working fluid within the separate volumes 332, 334, 340, 342 from communicating temperature and thereby allow the volumes 332, 334, 340, 342 to have different temperatures of working fluid, while equalizing pressure among the volumes 332, 334, 340, 342. The separators 330, 336, 338 may be made from a material that is thermally insulative to promote or enhance temperature stratification within the volumes 332, 334, 340, 342.

The port 360 is moveable within the cold side 306 with respect to the cold-side separators 330, 336, 338 and may be provided with a telescopic mechanism to facilitate movement. The port 360 may be moved to communicate a given volume 332, 334, 340, 342 with the warming flow path 318.

The apparatus 300 may further include a hot-side separator 344 positioned within the hot side 304 of the vessel 302 to divide the hot side 304 into separate volumes. Any suitable number of hot-side separators 344, 346, 348 may be provided to divide the hot side 304 into a corresponding number of volumes 350, 352, 354, 356 (shown empty in FIG. 3). The hot-side separators 344, 346, 348 are generally, within this example, the same as the cold-side separators, so the above discussion may be referenced for further detail. The hot-side separators 344, 346, 348 are positioned with respect to the ports 322, 326, which may be positioned at an end of the hot side 304 furthest from the displacers 308, 310. The port 322, 326 may be positioned to sequentially fill and empty volumes between the hot-side separators 344, 346, 348. Although these volumes are not visible in the state of the engine 300 shown in FIG. 3, they will be discussed below.

The primary displacer 308 is moveable to the hot side 304 of the vessel 302 to displace working fluid from the hot side 304 into the cold side 306 via the cooling flow path 316. The primary displacer 308 is moveable to the cold side 306 of the vessel to displace working fluid from the cold side 306 into the hot side 304 via the heating flow path 314.

The secondary displacer 310 is moveable away from the primary displacer 308 towards the cold side 306 to move working fluid from the cold side 306 to the intermediate volume 312 via a warming flow path 318.

Motion of the displacers 308, 310 may be controlled by respective actuators and a controller, as will be discussed in detail below. For sake of clarity, operation of the apparatus 300 now be discussed without reference to the actuators and controller.

Figure 4A:
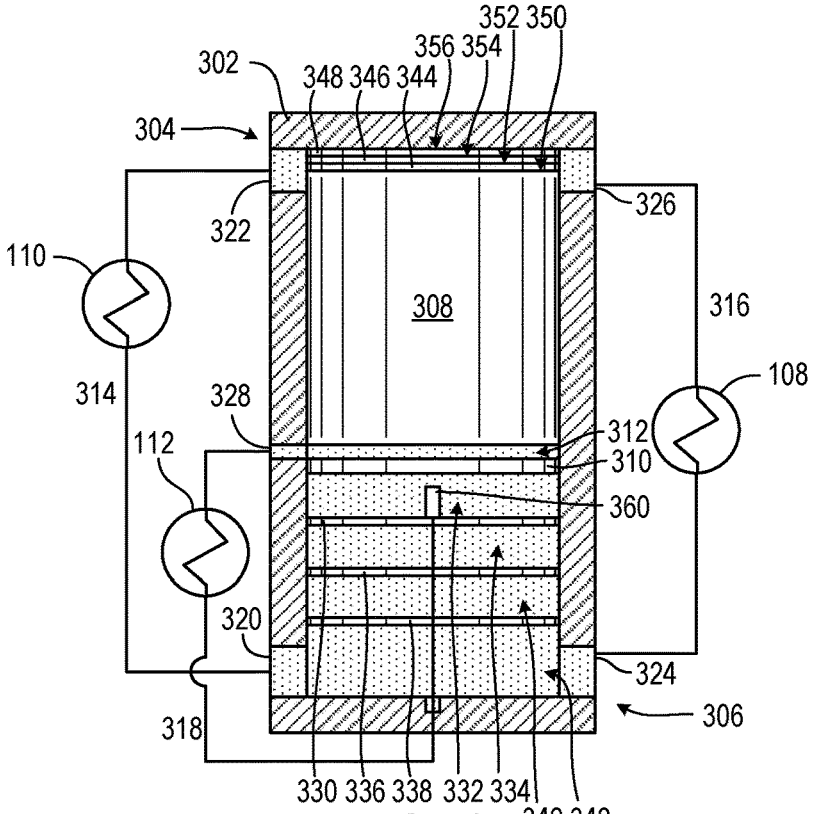
FIG. 4A is a cross-sectional side view of the apparatus of FIG. 3 in a cold state.

FIG. 4A shows what may be termed a cold state of the apparatus 300. Working fluid is present in the cold-side volumes 332, 334, 340, 342 as divided by the cold-side separators 330, 336, 338. The working fluid in the cold-side volumes 332, 334, 340, 342 may have different temperatures, which may be referred to as stratified temperatures, which may include temperatures below the heat sink temperature. The cold-side volume 332 may be the coldest volume, the cold-side volume 334 the second coldest, the cold-side volume 340 the third coldest volume, and so on. That is, the cold-side volumes 332, 334, 340, 342 may have stratified temperatures that are colder as the volume 332, 334, 340, 342 is closer to the displacers 308, 310. Pressure in the cold-side volumes 332, 334, 340, 342 may be equalized due to the movability of the separators 330, 336, 338. The primary displacer 308 is positioned fully at the hot side 304. The secondary displacer 308 is positioned near or adjacent to the primary displacer 308, so that the intermediate volume 312 is empty of useful working fluid. The hot-side separators 344, 346, 348 are adjacent each other, so that working fluid at the hot side 304 is minimal.

Figure 4B:
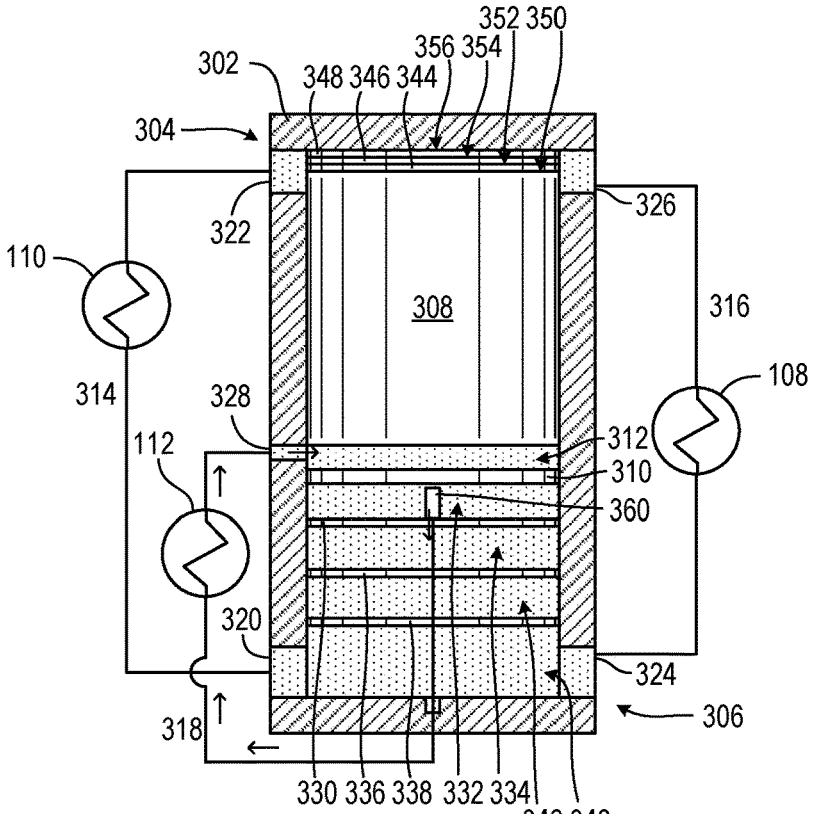
FIG. 4B is a cross-sectional side view of the apparatus of FIG. 3 during a warming stage.

FIG. 4B shows the beginning of a warming stage of operation. FIG. 2A and related description may be referenced. The secondary displacer 308 is moved towards the cold side 306, forcing working fluid from the cold-side volume 332 through the warming heat exchanger 112 and into the intermediate volume 312, via the warming flow path 318 and ports 360, 318. Note that the primary displacer 308 may be held stationary at this time, which has the effect of blocking the ports 322, 326 to prevent undesired flow of working fluid into the hot side 304. As the warming stage continues, a select number of the cold-side volumes 332, 334, 340, 342 sequentially empty in a sequence that is the same order as how they are filled, port 360 continues to move with the secondary displacer 310 such that cold fluid enters the warm flow path 318 adjacent to the secondary displacer 310 between the cold side 306 and the secondary displacer 310. The warming heat exchanger 112 warms the working fluid as it flows into the intermediate volume 312.

Figure 4C:
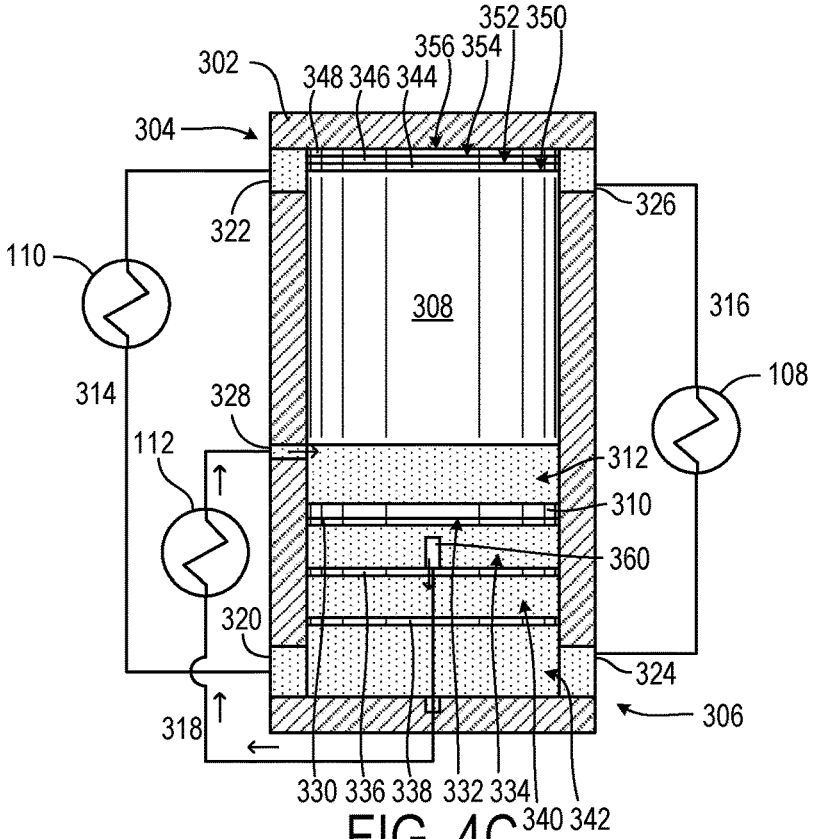
FIG. 4C is a cross-sectional side view of the apparatus of FIG. 3 later during the warming stage.

FIG. 4C shows the warming stage continuing. The secondary displacer 310 continues to move towards the cold side 306 while the cold side separators 330, 336, 338 remain stationary. At the state depicted, the cold-side volume 332 is completely empty and separator 330 is adjacent to the secondary displacer 310. The intermediate volume 312 continues to fill. The port 360 has moved into the next cold-side volume 334.

As the warming stage continues, the cold-side volumes 334, 340 are sequentially emptied into the intermediate volume 312, as the secondary displacer 310 moves further towards the cold side 306.

In various examples, the portion of working fluid transferred from the cold-side volumes 332, 334, 340, 342 to the intermediate volume 312 ranges from a portion of the working fluid in the cold-side volume 332 nearest the displacer 310 to all the working fluid in the cold-side volumes 332, 334, 340, 342.

Figure 4D:
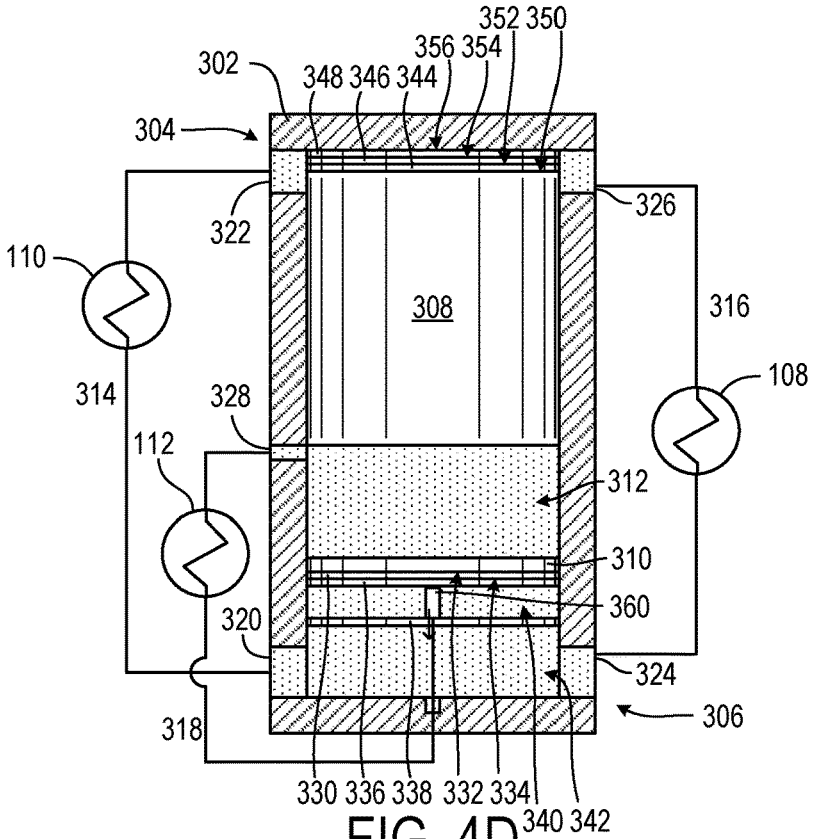
FIG. 4D is a cross-sectional side view of the apparatus of FIG. 3 in a warm state.

FIG. 4D shows the warming stage completed. A large portion of working fluid has been moved from the cold-side volumes 332, 334, 340, warmed, and moved into the intermediate volume 312. Some working fluid remains in the cold-side volumes 340, 342. This may be referred to as a warm state of the apparatus 300.

The heating stage may then begin. FIG. 2B and related description may be referenced.

Figure 4E:
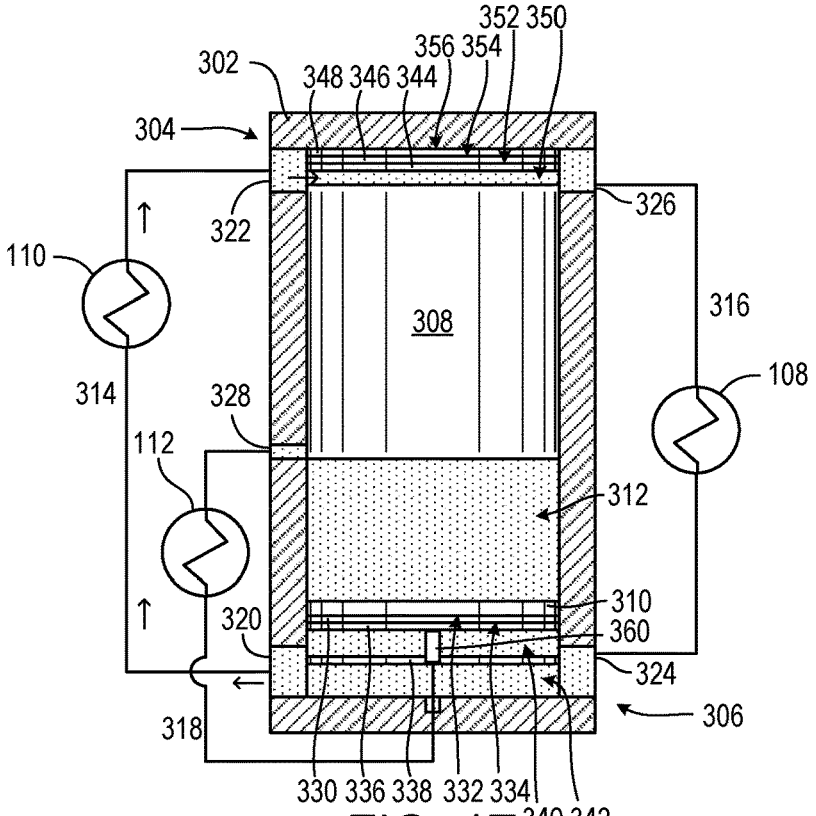
FIG. 4E is a cross-sectional side view of the apparatus of FIG. 3 during a heating stage.

FIG. 4E shows the beginning of the heating stage of operation. The primary displacer 308 is moved toward the cold side 306. The secondary displacer 310 moves in the same direction, whether by actuation or by force of the primary displacer 308 on working fluid in the intermediate volume 312. The cold-side volumes 340, 342 continue to sequentially empty, this time flowing through the hot-side heat exchanger 110 and into hot-side volumes 350, 352, 354, 356 defined by the hot-side separators 344, 346, 348, via the heating flow path 314 and ports 320, 322. The hot-side volumes 350, 352, 354, 356 sequentially fill.

Figure 4F:
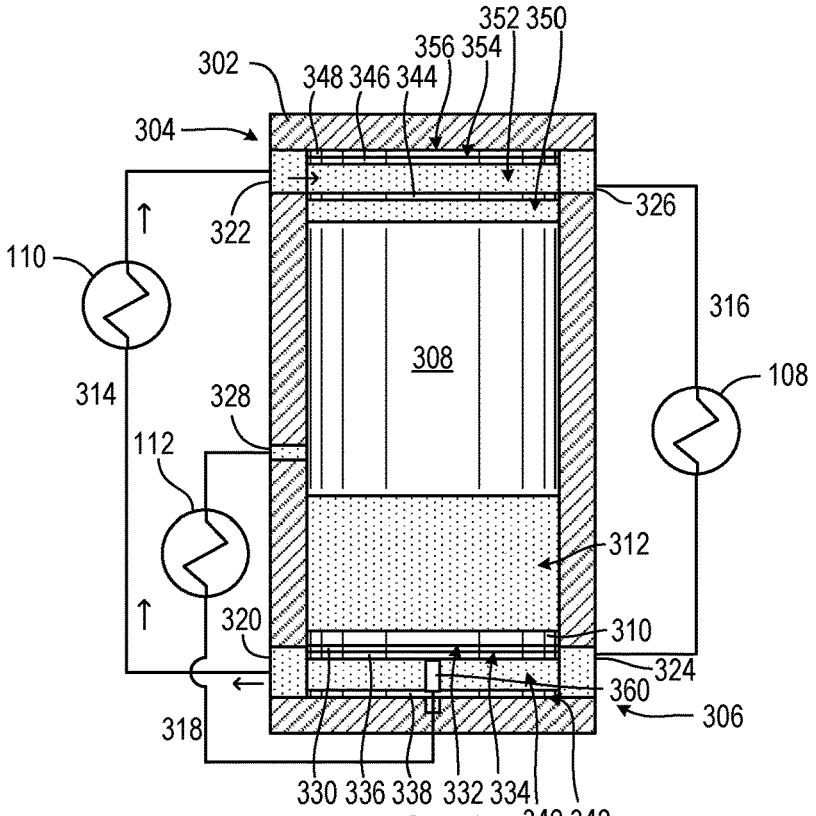
FIG. 4F is a cross-sectional side view of the apparatus of FIG. 3 later during the heating stage.

FIG. 4F shows the heating stage continuing. The cold-side volumes 340,342 sequentially empty as the hot-side (third and fourth) volumes 350, 352 sequentially fill. The intermediate volume 312 does not fill or empty. Each hot-side volume 350, 352, 354, once filled, continues to increase in pressure, thus increasing in temperature due to near adiabatic compression caused by increase in pressure, as other hot-side volumes 352, 354, 356 are sequentially filled.

Figure 4G:
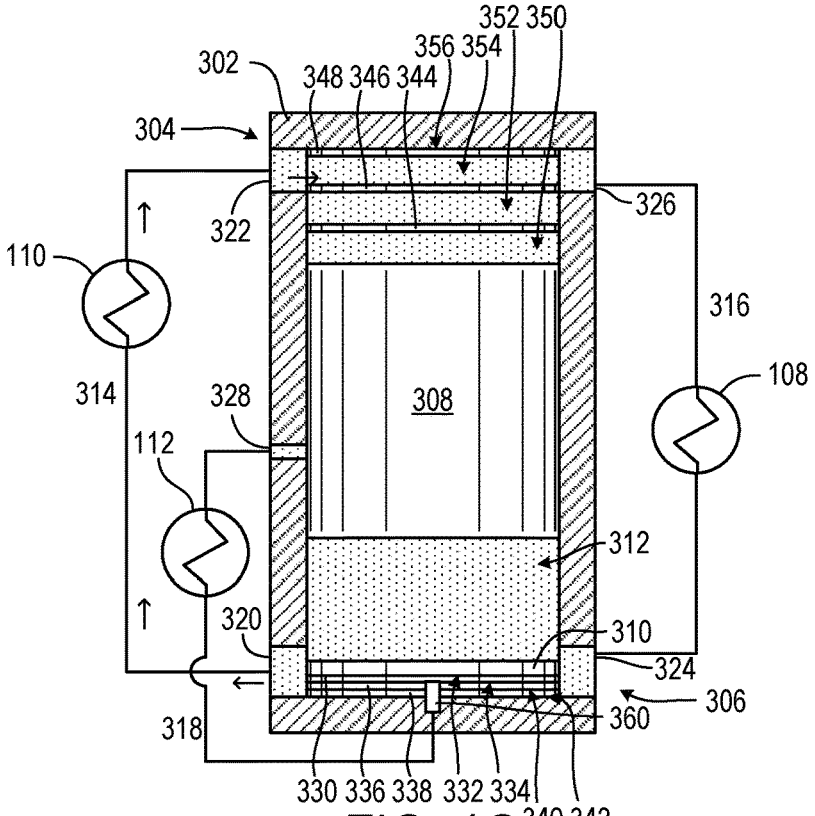
FIG. 4G is a cross-sectional side view of the apparatus of FIG. 3 still later during the heating stage.

FIG. 4G shows the continued heating stage. FIG. 2C and related description may be referenced. The cold-side volumes 332, 334, 340, 342 are completely empty. The secondary displacer 310 stops at its further extend of movement into the cold side 306. Continued movement of the primary displacer 308 empties the intermediate volume 312 of working fluid, which flows through the hot-side heat exchanger 110 and into hot-side volumes 352, 354, 356 defined by the hot-side separators 344, 346, 348, via the heating flow path 314 and ports 320, 322.

Figure 4H:
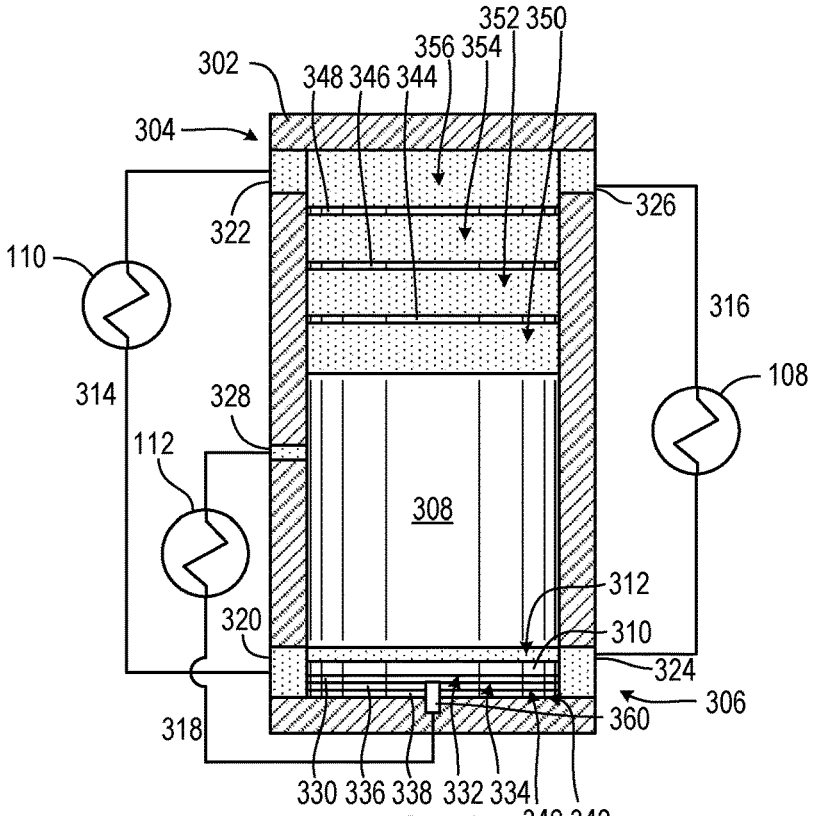
FIG. 4H is a cross-sectional side view of the apparatus of FIG. 3 in a hot state.

FIG. 4H shows the end of the continued heating stage. The apparatus 300 is at what may be termed a hot state. Working fluid is present in the hot-side volumes 350, 352, 354, 356 as divided by the hot-side separators 344, 346, 348. The working fluid in the hot-side volumes 350, 352, 354, 356 may have different temperatures, which may be referred to as stratified temperatures. The hot-side volume 350 may be the hottest volume, the hot-side volume 352 may be the second hottest volume, the hot-side volume 354 may be the third hottest volume, and so on. In other words, the hot-side volumes 350, 352, 354, 356 may have stratified temperatures that are hotter as the volume 350, 352, 354, 356 is closer to the displacer 308. Pressure in the hot-side volumes 350, 352, 354, 356 may be equalized due to the movability of the separators 344, 346, 348. The primary displacer 308 is positioned fully at the cold side 306. The secondary displacer 310 is positioned near or adjacent to the primary displacer 308, so that the intermediate volume 312 is empty of useful working fluid. The cold-side separators 330, 336, 338 are adjacent each other, so that working fluid at the cold side 306 is minimal.

The cooling stage may then begin. FIG. 2D and related description may be referenced.

Figure 4I:
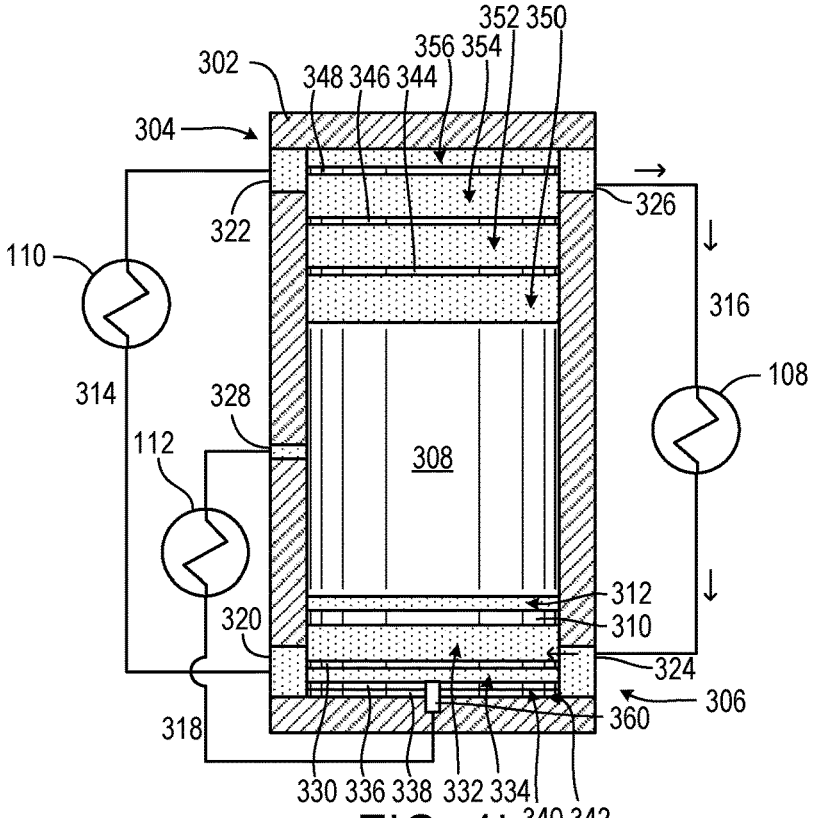
FIG. 4I is a cross-sectional side view of the apparatus of FIG. 3 during a cooling stage.

FIG. 4I shows the cooling stage of operation. The primary displacer 308 is moved toward the hot side 304. The secondary displacer 310 moves in the same direction and remains close to the primary displacer 308, so that the intermediate volume 312 does not have significant in or out flow of working fluid. The hot-side volumes 350, 352, 354, 356 sequentially empty of working fluid in a sequence reverse to the filling sequence. Working fluid flows out of the hot-side volumes 350, 352, 354, 356, cools as it flows through the cold-side heat exchanger 108, and sequentially fills the cold-side volumes 332, 334, 340, 342, via the cooling flow path 316 and ports 324, 326.

Each cold-side volume 332, 334, 340, once filled, continues to reduce in pressure, thus reducing in temperature due to near adiabatic expansion caused by reduction in pressure, as other cold-side volumes 334, 340, 342 are sequentially filled. Due to this expansion of working fluid, the temperature of working fluid at cold side volumes 332, 334, 340, 342, particularly those volumes closest the secondary displacer 310, may drop below the temperature of the cold sink that exists at the cold-side heat exchanger 108, which may allow the warming heat exchanger to use a heat exchange fluid with a temperature that is colder than the cold-side heat exchanger 108.

Figure 4J:
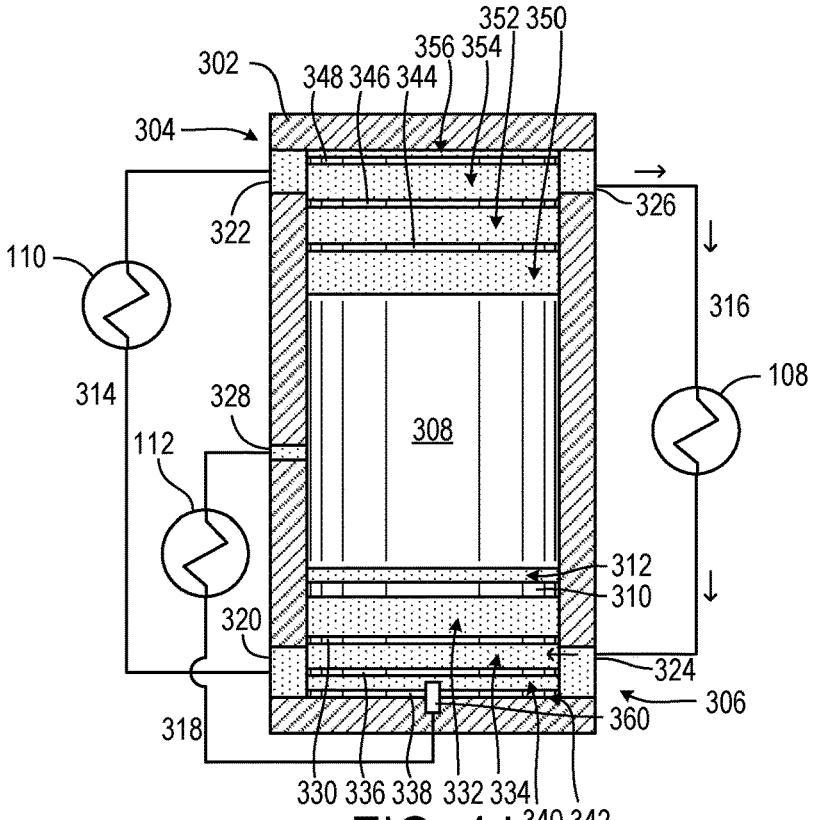
FIG. 4J is a cross-sectional side view of the apparatus of FIG. 3 later during the cooling stage.

FIG. 4J shows the cooling stage of operation continuing. The primary displacer 308 continues to move toward the hot side 304. The secondary displacer 310 moves in the same direction and remains close to the primary displacer 308, so that the intermediate volume 312 does not have significant in or out flow of working fluid. The hot-side volumes 350, 352, 354, 356 continue to sequentially empty of working fluid and the cold-side volumes 332, 334, 340, 342 continue to fill.

The cooling stage ends at the cold state, which is shown in FIG. 4A. The cycle then repeats.

Figure 5:
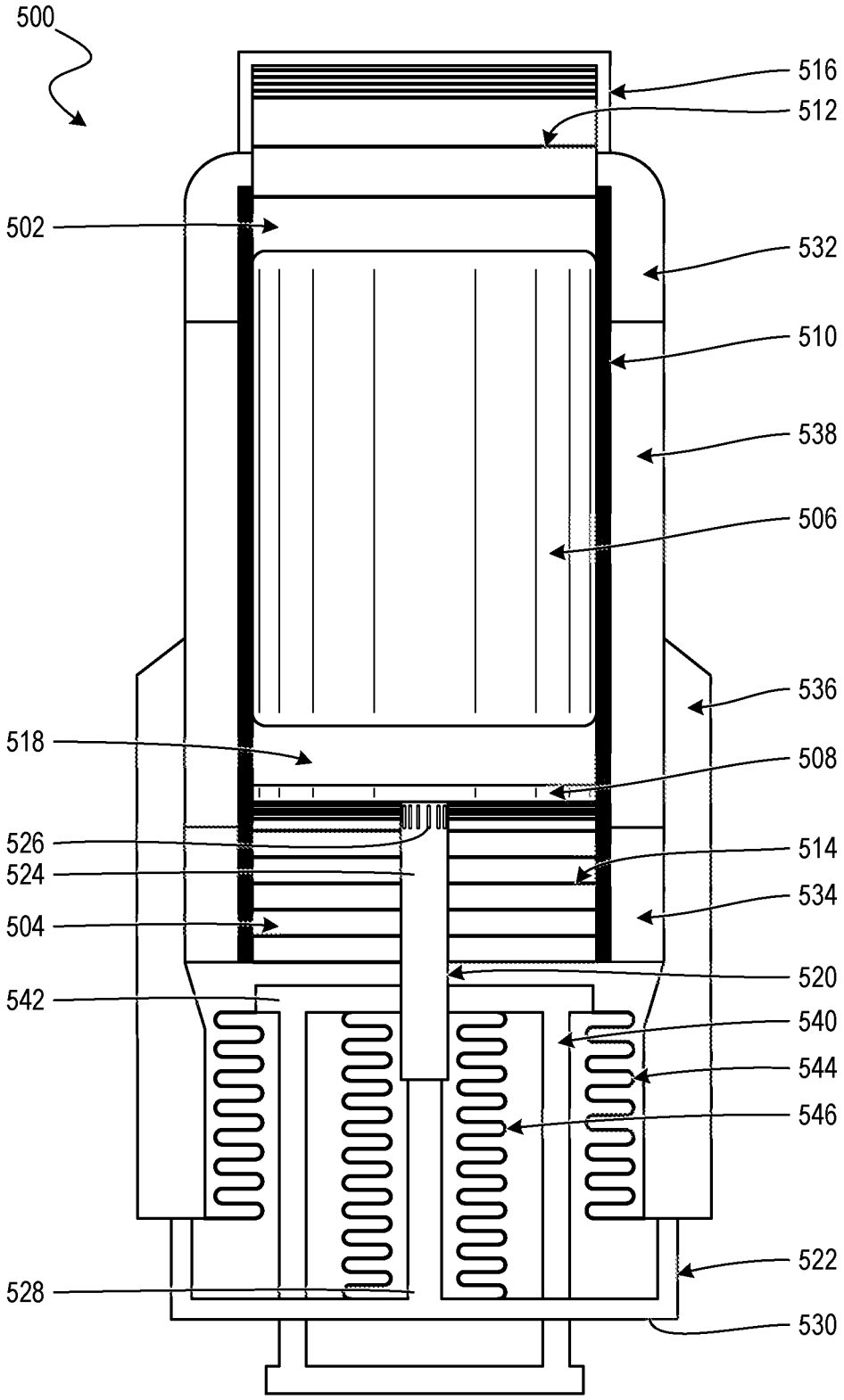
FIG. 5 is a schematic side view of another example apparatus with moveable separators.

FIG. 5 shows another example apparatus 500. The apparatus 500 may be considered thermodynamically equivalent to the apparatuses 100 and 300. The discussion above for the apparatuses 100 and 300 may be referenced for details of components with similar reference numerals and/or terminology. The discussion below concerning the mechanics of the apparatus 500 may be referenced to aid understanding of the apparatuses 100 and 300.

The apparatus 500 includes a vessel that has a hot side 502 and a cold side 504. The hot side 502 and cold side 504 are separated by a primary displacer 506 and a secondary displacer 508. The displacers 506, 508 may be cylindrical bodies that are slidably disposed within a hollow cylindrical tube 510.

A series of hot-side separators 512 is provided at the hot side 502. A similar series of cold-side separators 514 are provided at the cold side 504. The hot-side separators 512 and cold-side separators 514 are on opposite sides of the displacers 506, 508. A containment body 516 may be provided to stow the hot-side separators 512. The containment body 516 may have the same general shape as the tube 510. The separators 512, 514 are slidable within in the tube 510 and containment body 516.

The separators 512, 514 define temperature-isolated volumes for working fluid therebetween. The separators 512, 514 may allow for stratification of temperature among respective volumes and, due to their movability, may provide for pressure equalization among respective volumes. Any suitable number (e.g., 1 to 9) of hot-side separators 512 may be used to define a corresponding number (e.g., 2 to 10) of hot-side volumes. Likewise, any suitable number (e.g., 1 to 9) of cold-side separators 514 may be used to define a corresponding number (e.g., 2 to 10) of cold-side volumes.

The primary displacer 506 and secondary displacer 508 are independently slidable within the tube 510 and provide a variable intermediate volume 518 therebetween.

A telescopic port assembly 520 is provided to the cold side 504 to selectively communicate volumes between the cold-side separators 514 to a manifold 522. The telescopic port assembly 520 includes a tube 524 extending through the cold side 504 with openings 526 at an end adjacent the secondary displacer 508. The end of the tube 524 adjacent the secondary displacer 508 may be attached to the secondary displacer 508 and move with the secondary displacer 508.

The manifold 522 includes an inner tube 528 on which the tube 524 bearing the openings 526 slides, so as to allow the openings 526 to change position in the cold side 504 and communicate with different volumes defined by the cold-side separators 514. That is, the outer tube 524 and inner tube 528 forming the telescopic port assembly 520 to provide for variable positioning of the openings 526. The manifold 522 further includes an arm 530 extending laterally from the inner tube 528. Any suitable number of arms 530 may be provided.

The telescopic port assembly 520 is an example implementation of the port 360 discussed above with regard to FIGS. 3 and 4.

The apparatus 500 further includes a hot-side heat exchanger 532, a cold-side heat exchanger 534, a warming heat exchanger 536, and a regenerator 538, each of which may have an annular shape that surrounds the central tube 510 that contains the displacers 506, 508 and separators 512, 514. In this example, the warming heat exchanger 536 surrounds the cold-side heat exchanger 534 and the regenerator 538, which in turn surround the central tube 510. The heat exchangers 532, 534, 536 thermally couple working fluid to various heat exchange fluids.

The hot-side heat exchanger 532, cold-side heat exchanger 534, warming heat exchanger 536, regenerator 538 may be mutually connected and also connected to the hot side 502 and cold side 504 by various flow paths, as will be discussed in detail below.

The regenerator 538 may collect heat from the working fluid when working fluid is being displaced from the hot side 502 into the cold side 504 and discharge heat when working fluid is being displaced from the cold side 504 or intermediate volume 312 into the hot side 502.

The apparatus 500 further includes a power output component 540 positioned to form a boundary that contains working fluid. The power output component 540 includes a pressure plate 542 that forms such a boundary and is acted upon by pressure of the working fluid. The power output component 540 is movable in response to a change in pressure of the working fluid within the apparatus 500, which results in a change in volume, specifically, working fluid at the cold side 504 acting on the pressure plate 542. The power output component 540 may oscillate in response to working fluid being heated and cooled as the engine 500 operates. As such, work may be extracted from the apparatus 500. For example, a mechanism that converts linear oscillatory motion to rotary motion may be connected to the power output component 540 to drive an electric generator or other machine capable of extracting work, such as a compressor or mechanical system.

Bellows seals 544, 546 may be provided to the power output component 540 to allow movement of the power output component 540 while maintaining the working fluid boundary and the closed nature of the apparatus 500. Outer bellows seal 544 may surround the power output component 540 and connect the pressure plate 542 to the warming heat exchanger 536. Inner bellows seal 546 may surround the telescopic port assembly 520 and connect the pressure plate 542 to the manifold 522.

Figure 6:
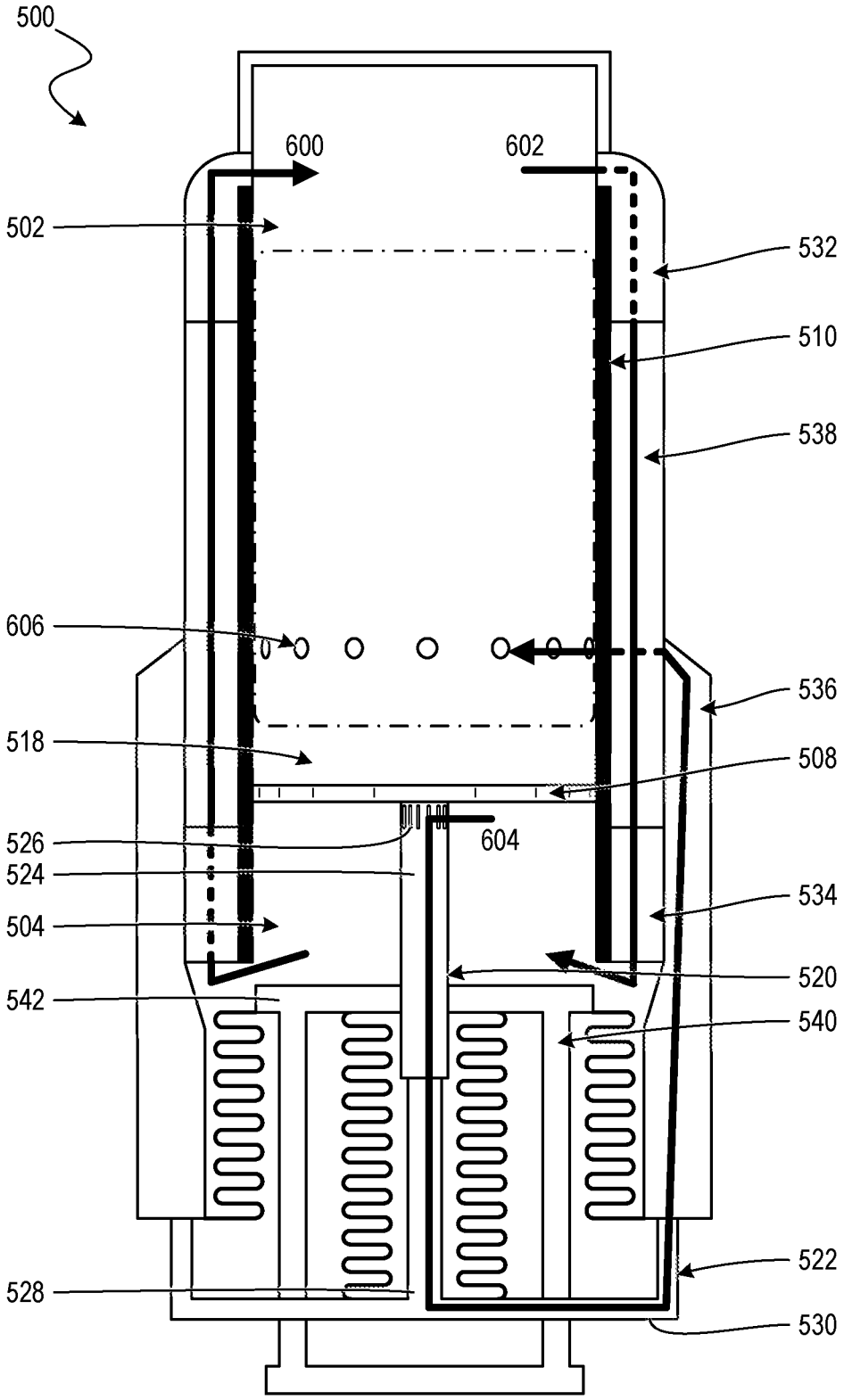
FIG. 6 is a schematic side view of the apparatus of FIG. 5 showing working fluid flow paths.

FIG. 6 shows the apparatus 500 with working fluid flow paths illustrated. Various fluid communication openings or ports are not shown for sake of clarity. The configuration and positioning of fluid communication openings or ports are readily inferable from the below discussion. Other components such as the separators and primary displacer are omitted for sake of clarity.

A heating flow path 600 (or cold-side to hot-side flow path) extends from the cold side 504, runs through the regenerator 538 and the hot-side heat exchanger 532, and ends at the hot side 502. The heating flow path 600 is thermally coupled to the hot-side heat exchanger 532 to heat the working fluid. Due to geometric constraints, the heating flow path 600 may run through the cold-side heat exchanger 534 (at dashed line) and may be configured to thermally bypass the cold-side heat exchanger 534 by way of valving, an insulated through-passage or similar structure.

A cooling flow path 602 (or hot-side to cold-side flow path) extends from the hot side 502, runs through the regenerator 538 and the cold-side heat exchanger 534, and ends at the cold side 504. The cooling flow path 602 is thermally coupled to the cold-side heat exchanger 534 to cool the working fluid. Due to geometric constraints, the cooling flow path 602 may run through the hot-side heat exchanger 532 (at dashed line) and may be configured to thermally bypass the hot-side heat exchanger 532 by way of valving, an insulated through-passage or similar structure.

A warming flow path 604 extends from the cold side 504, through the telescopic port assembly 524, via its openings 526, through the manifold 522 and the warming heat exchanger 536, and into the intermediate volume 518 via warming-path discharge ports 606 in the central tube 510. The warming flow path 604 is thermally coupled to the warming heat exchanger 536 to warm the working fluid. Due to geometric constraints, the warming flow path 604 may run through the regenerator 538 (at dashed line) and may be configured to thermally bypass the regenerator 538 by way of an insulated through-passage or similar structure.

The cycle of working fluid through the flow paths 600, 602, 604 may be as discussed elsewhere herein. Working fluid at the cold side 504 may be warmed via the warming flow path 604 on its way to the intermediate volume 518. Subsequently, working fluid remaining at the cold side 504 and in the intermediate volume 518 may be heated via the heating flow path 600 at it enters the hot side 502. Then, working fluid at the hot side 502 may be cooled as it flows via the cooling flow path 602 to the cold side 504.

Figure 7:
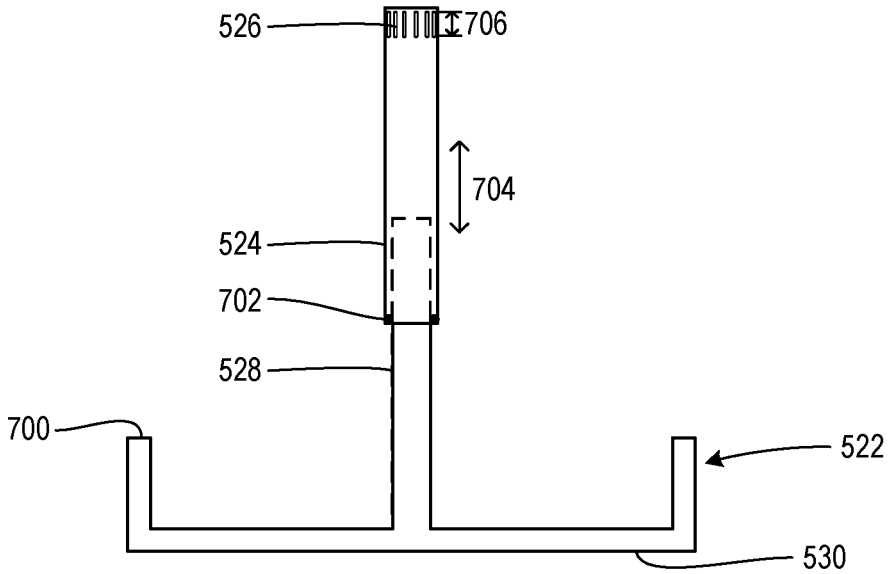
FIG. 7 is a schematic side view of the telescopic port assembly and manifold of the apparatus of FIG. 5.

With reference to FIG. 7, the telescopic port assembly 520 and manifold 522 are shown. A longitudinally extending tube 524 includes openings 526 at an end positionable within the cold side 504 of the apparatus 500 (FIG. 5). The tube 524 is telescopically mated with another longitudinally extending tube 528 that extends from any suitable number (e.g., 2, 4, 8, etc.) of radially extending arms 530 of the manifold 522. The arm 530 ends at a port 700 that is communicated to the warming heat exchanger 536 (FIG. 5). Hence, working fluid is constrained to flow within the telescopic port assembly 520 and manifold 522 between the openings 526 and port 700.

The tubes 524, 528 may be telescopically mated to provide a seal against leakage of working fluid. In this example, tube 524 fits over the tube 528 with a seal 702 at the end of the outer tube 524 opposite the openings 526. The outer tube 524 may slide relative to the inner tube 528 along axis 704 to position the openings 526 at a suitable location within the cold side 504 among the cold-side separators 514 (FIG. 5). The openings 526 may be sized with regard to the spacing of the cold-side separators 514 to allow for a number of cold-side volumes, determined by the control system, between the cold-side separators 514 to communicate to the port 700. In this example, the length 706 of openings 526 parallel to the series arrangement of cold-side separators 514, i.e., parallel to the tubes 524, 528, is shorter than the longest spacing between the cold-side separators 514, so that one full volume between adjacent cold-side separators 514 is communicated with the port 700 at a given time.

Figure 8:
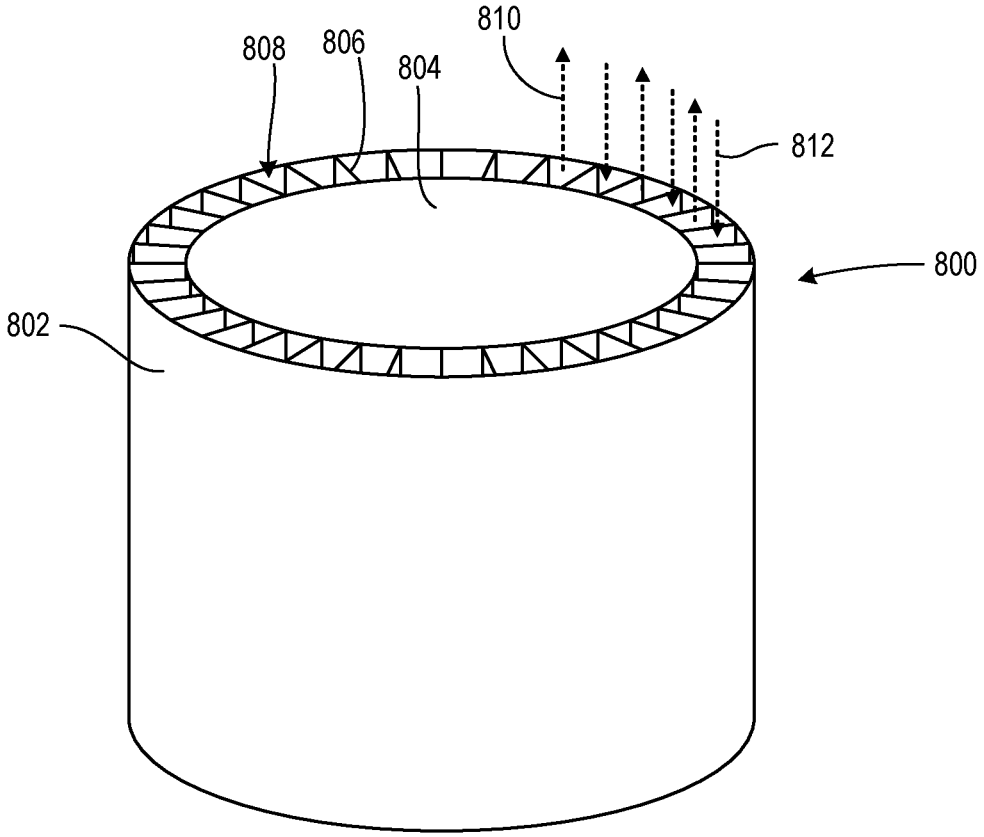
FIG. 8 is a perspective diagram of a heat exchanger useable with the apparatus of FIG. 5.

FIG. 8 shows an example heat exchanger 800 that may be used for any of the hot-side heat exchanger 532, cold-side heat exchanger 534, and/or warming heat exchanger 536, discussed above with respect to FIGS. 5 and 6. The heat exchanger 800 includes an outer shell 802 and an inner shell 804 disposed within the outer shell 802. The shells 802, 804 may be concentric hollow cylinders. An array of radial plates 806 may be positioned between the shells 802, 804 to divide the space between the shells 802, 804 into an array of longitudinal channels 808. Working fluid and heat-exchange fluid may be flowed through alternate channels 808 to maximize thermal coupling of working fluid and heat-exchange fluid. The radial plates 806 may be thermally conductive to promote heat transfer between adjacent channels. Working fluid may flow in a direction 810 counter to a direction 812 of flow of heat-exchange fluid. In other examples, the fluids may flow in the same direction.

Figure 9A:
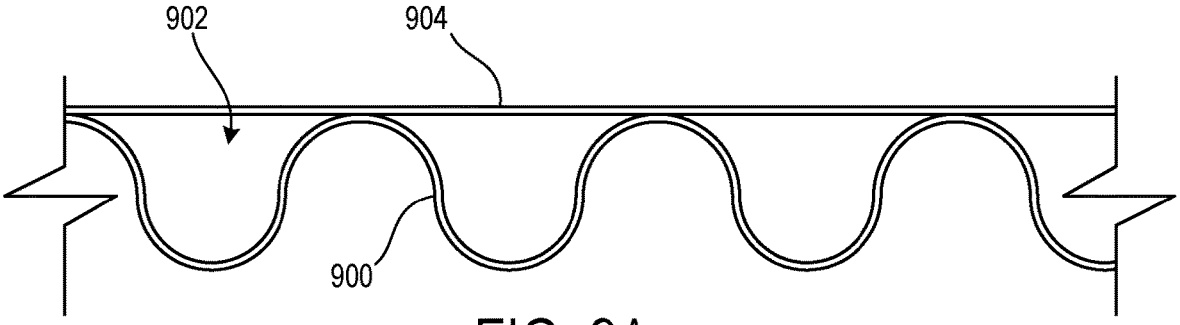
FIG. 9A is a cross-sectional view of regenerator foil useable with the apparatus of FIG. 5.
Figure 9B:
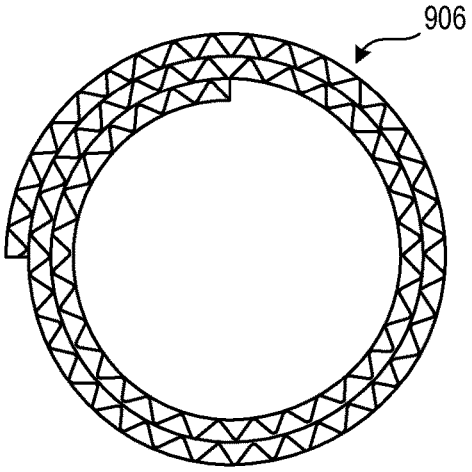
FIG. 9B is an end view of a wrap of regenerator foil of FIG. 9A.

FIGS. 9A and 9B show an example material that may be used for the regenerator 538. A sheet 900 of highly thermally conductive material may be given a corrugated, embossed, or similar structure that defines passages 902 therebetween. A backing sheet 904 may be provided to the embossed or corrugated sheet 900 of material to enclose the passages 902. The structure formed of combined sheets 900, 902 may be wrapped (single wrap or multiple) around the body of the apparatus 500 to form the regenerator 538, which may take the form of an annulus 906. The passages 902 may be relatively small to encourage heat transfer. The number of passages 902 may be large, so as to allow a relatively large mass of working fluid to flow through the regenerator 538 and to allow a large mass of material 900, 904 to act as a thermal capacitor.

Figure 10A:
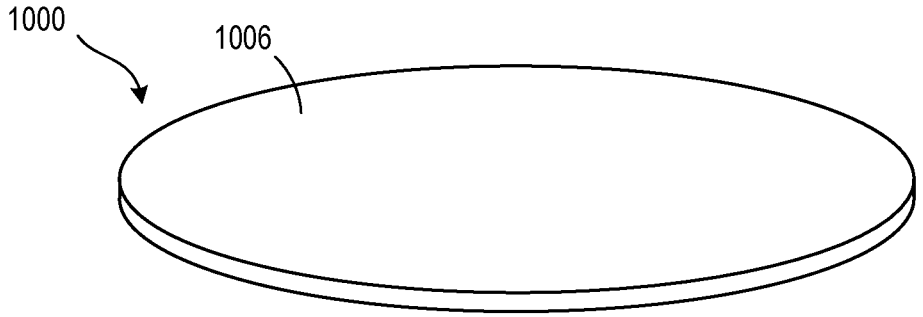
FIG. 10A is a perspective view of a separator useable with the apparatus of FIG. 5.
Figure 10B:
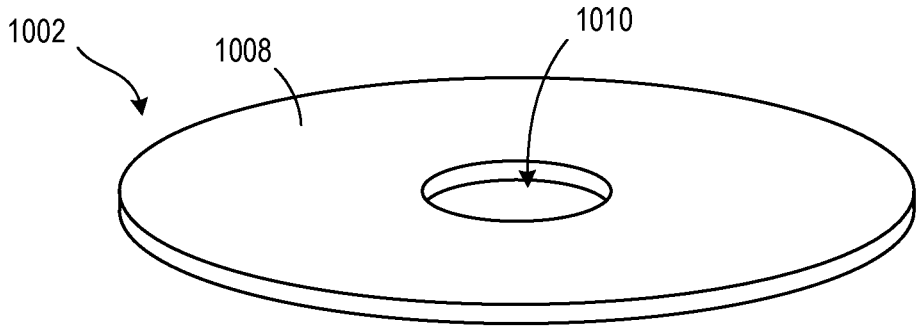
FIG. 10B is a perspective view of a separator with an opening useable with the apparatus of FIG. 5.
Figure 10C:
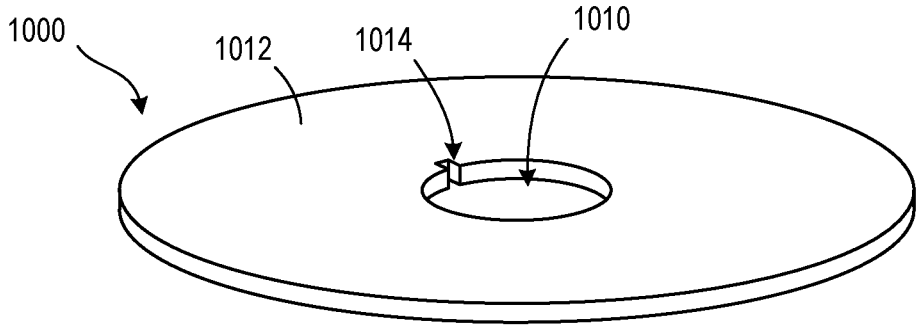
FIG. 10C is a perspective view of a separator with an opening and anti-rotation useable with the apparatus of FIG. 5.

FIGS. 10A, 10B, and 10C show respective example separators 1000, 1002, 1004 useable as the separators of the apparatuses discussed herein, such as the separators 512, 514 of the apparatus 500 of FIG. 5.

As shown in FIG. 10A, example separator 1000 includes a solid thin disc 1006, which may be made of rigid material, such as metal or plastic. The disc 1006 material may be of thermally insulative material, as well, such as plastic, coated metal or insulation filled plates. The disc 1006 may mate with the inside of the hollow cylindrical tube 510 of the engine 500 of FIG. 5. The outer perimeter of the disc 1006 may form a moveable seal with the cylindrical tube 510.

The separator 1002 of FIG. 10B includes a thin disc 1008 that is similar to the disc 1006 with a central opening 1010 therein. The opening 1010 may be shaped and sized to accommodate the telescopic port assembly 520 at the cold side 504 of the engine 500 of FIG. 5 or to accommodate a sleeve that accommodates an actuator arm that extends through the hot side 502, as discussed below. The central opening 1010 may be circular or other shape. The central opening 1010 may form a movable seal with the telescopic port assembly 520 or actuator sleeve.

The separator 1004 of FIG. 10C includes a thin disc 1012 that is similar to the disc 1008 and that includes a notch 1014 or other feature at a circular central opening 1010 to prevent rotation of the disc 1012. The notch 1014 mates with a ridge on the telescopic port assembly 520 or actuator sleeve.

Figure 11:
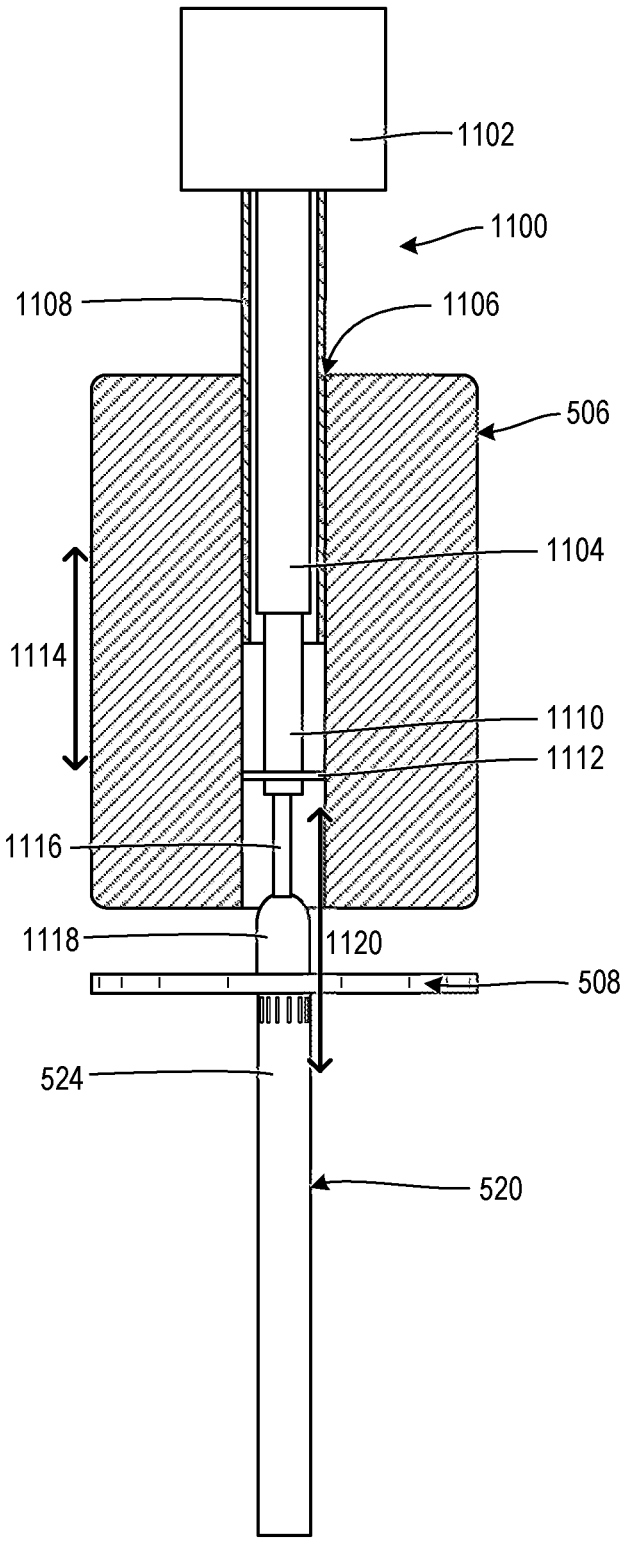
FIG. 11 is a cross-sectional side view of an actuator assembly useable with the apparatus of FIG. 5.

FIG. 11 shows an actuator assembly 1100 useable with the apparatus 500 of FIG. 5.

The actuator assembly 1100 includes an actuator 1102 that includes an extended portion 1104 that extends through a bore 1106 in the primary displacer 506. A sleeve 1108 may be inserted through the bore 1106 and the extended portion 1104 of the actuator 1102 may reside within the sleeve 1108. The sleeve 1108 may form a moving seal with the bore 1106 in the primary displacer 506 to keep working fluid out.

A first actuating rod 1110 may extend from the extended portion 1104 of the actuator 1102. The first actuating rod 1110 may be attached to an inside of the primary displacer 506, within the bore 1106, by an attachment part 1112. The first actuating rod 1110 may be linearly extendible and retractable from the extended portion 1104 of the actuator 1102 to move the primary displacer 506 along an axis 1114.

A second actuating rod 1116 may extend from the extended portion 1104 of the actuator 1102. The first actuating rod 1110 may be hollow to accommodate the second actuating rod 1116 therein. In other examples, the actuating rods 1110, 1116 are positioned side-by-side. The second actuating rod 1116 may be connected to a bell shroud 1118 that is attached to the secondary displacer 508. The bell shroud 1118 may be a hollow extension of the tube 524 of the telescopic port assembly 520, where the outside of the tube 524 and/or shroud 1118 attaches to the secondary displacer 508 where it extends through an opening in the secondary displacer 508, that may intermittently accommodate the inner tube 528 shown in FIG. 7. The second actuating rod 1116 may be linearly extendible and retractable from the extended portion 1104 of the actuator 1102 to move the secondary displacer 508, bell shroud 1118, and tube 524 in unison along an axis 1120. Note that the axes 1114, 1120 in this example are coincident and are shown separately for sake of clarity.

Figure 12A:
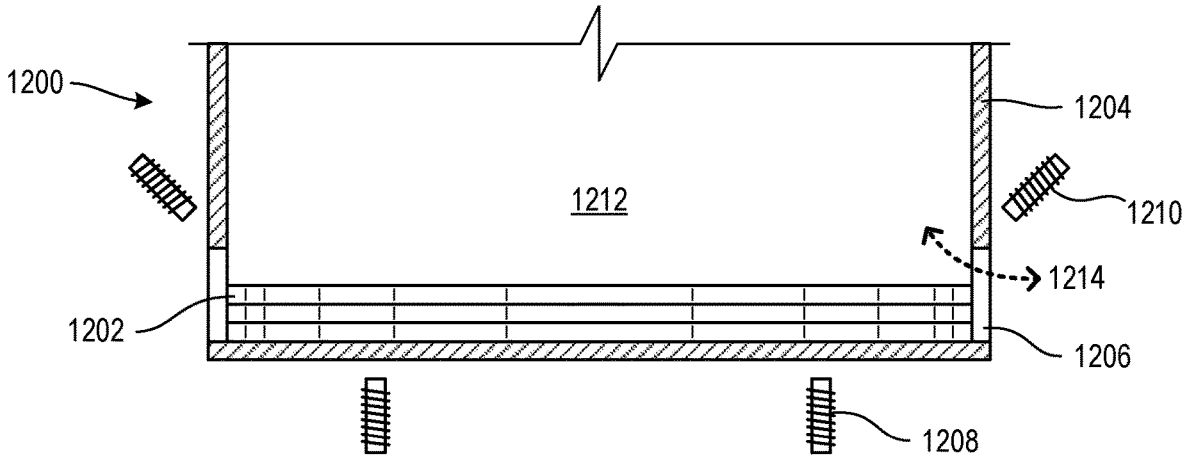
FIG. 12A is a cross-sectional side view of a separator deployment assembly useable with the apparatus of FIG. 5 with separators stowed.
Figure 12B:
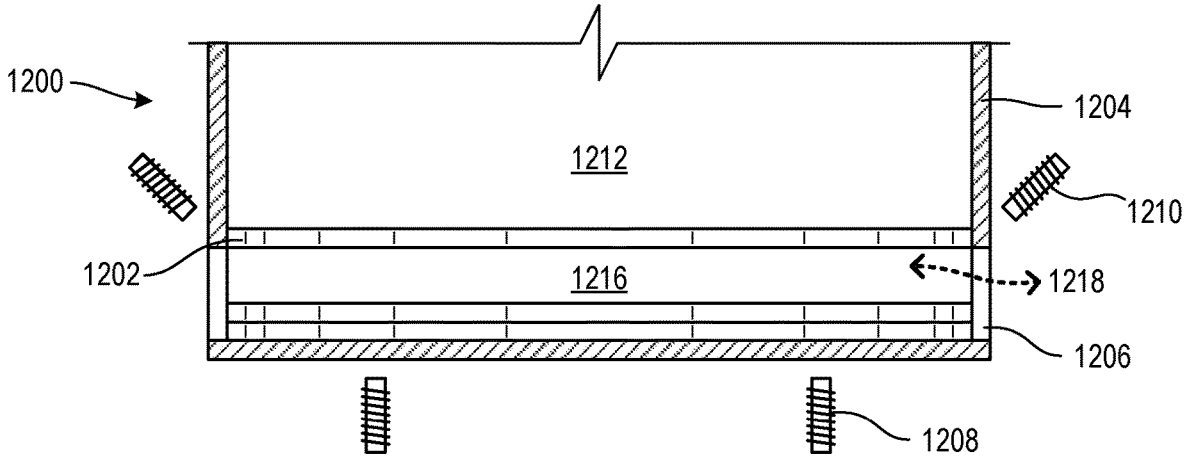
FIG. 12B is a cross-sectional side view of the separator deployment assembly of FIG. 12A with a separator at a transition position.
Figure 12C:
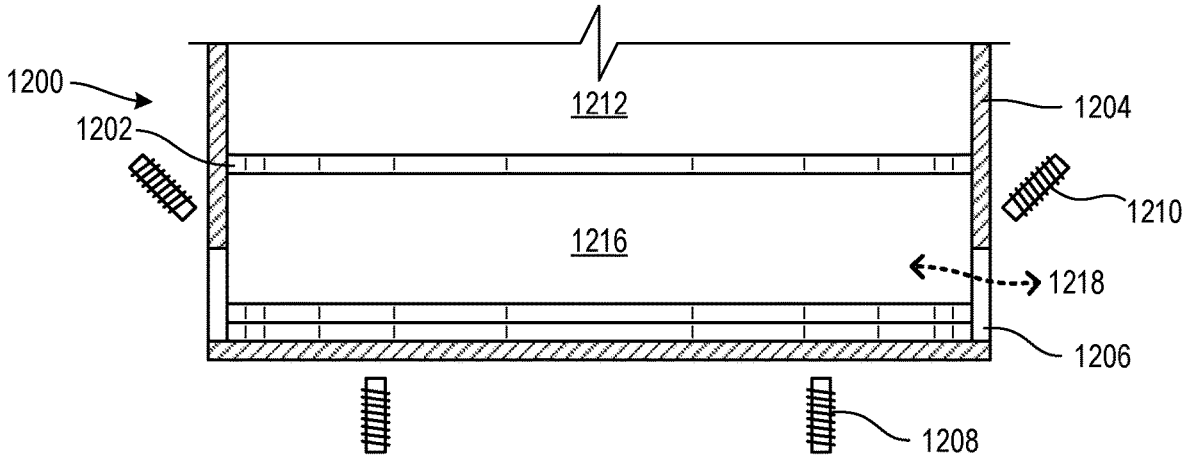
FIG. 12C is a cross-sectional side view of the separator deployment assembly of FIG. 12A with a separator at an active position.

FIGS. 12A 12B, and 12C show a separator deployment assembly 1200 useable with the apparatuses discussed herein. The separator deployment assembly 1200 may be used to store, deploy, and recover separators 1202, such as separators 512, 514 of the apparatus 500.

The separator deployment assembly 1200 includes a container 1204 or region to stow separators 1202 when not in use. The container 1204 may be part of a vessel or tube that defines a hot and/or cold side of the apparatus 500. The container 1204 may have one or more ports 1206 therein for inflow and/or outflow of working fluid.

The separator deployment assembly 1200 further includes a stowing magnet 1208 positioned adjacent an end of the container 1204 to attract separators 1202 into the end of the container 1204 for stowage. Any number of stowing magnets 1208 may be used. The stowing magnets 1208 may be permanent magnets or electromagnets, and may be located as shown in assembly 1200 or located within the actuator sleeve, tube 524, on the separators 512, 514 or other such location.

The separator deployment assembly 1200 further includes a transition magnet 1210 positioned at a side of the container 1204 to attract separators 1202 to a transition position within the container 1204 for deployment and/or recovery. The transition magnet 1210 may be positioned past the port 1206 towards the inside of the container 1204, so as to hold a separator 1202 at a position with respect to the port 1206 that allows working fluid to flow in or out of the container 1204 only on one side of the separator 1202. The transition magnet 1210 may be angled towards the stowage area of the separators 1202 to increase the magnetic attraction acting on the separators 1202 to pull the separators 1202 away from the stowage area. An example angle is 45 degrees. Any number of transition magnets 1210 may be used. Transition magnets 1210 may be arranged radially around the container 1204. The transition magnets 1210 are electromagnets and may be located as shown on assemble 1200 or located within the actuator sleeve, tube 524, on the separators 512, 514 or other such location.

FIG. 12A shows the separator deployment assembly 1200 with separators 1202 stowed. Working fluid may flow into or out of a first volume 1212 inside the container 1204 past the separators 1202, as indicated by arrow 1214. The stowing magnets 1208 hold the separators 1202 in place. There may be magnets attached to the separators to assist with stowing the separators.

FIG. 12B shows a separator 1202 attracted to the transition position by the transition magnets 1210. The transition magnets 1210 may be turned on or have their power increased to overcome the attractive force of the stowing magnets 1208, which may be turned off or have their power decreased (if electromagnets are used) to allow the separator 1202 to readily leave the stowed position. At this point, the first volume 1212 is isolated from the port 1206 by the separator 1202 and working fluid may flow into or out of a second volume 1216 between the transitioning separator 1202 and the next stowed separator, as indicated by arrow 1218.

FIG. 12C shows the separator 1202 in the active position, in which its position is governed by working fluid pressure within the volumes 1212, 1216. The transition magnets 1210 turned off or reduced in power to release the separator 1202 from the transition position. Working fluid may still flow into or out of a second volume 1216 between the separator 1202 and the next stowed separator, as indicated by arrow 1218.

When separators 1202 are being deployed, the sequence of steps may follow FIG. 12A, FIG. 12B, and then FIG. 12C, in that order. That is, the transition magnets 1210 may be energized to pull the separator 1202 from the stowed position into the transition position, working fluid may flow into the second volume 1216, and then the transition magnets 1210 may be deenergized to allow the separator 1202 to move away from the port 1206 as more working fluid flows into the second volume 1216. Then, the transition magnets 1210 may be energized again to pull the next separator 1202 to be deployed into the transition position, and so on.

When separators 1202 are being recovered, the sequence of steps may follow FIG. 12C, FIG. 12B, and then FIG. 12A, in that order. That is, the displacer movement acting on the working fluid pulls the separator 1202 towards the stowed position into the transition position, working fluid may flow out of the second volume 1216, and then the transition magnets 1210 may be energized with reverse polarity to combine with the stowing magnets 1208 to attract the separator 1202 towards the stowed position as more working fluid flows out of the second volume 1216.

Figure 13:
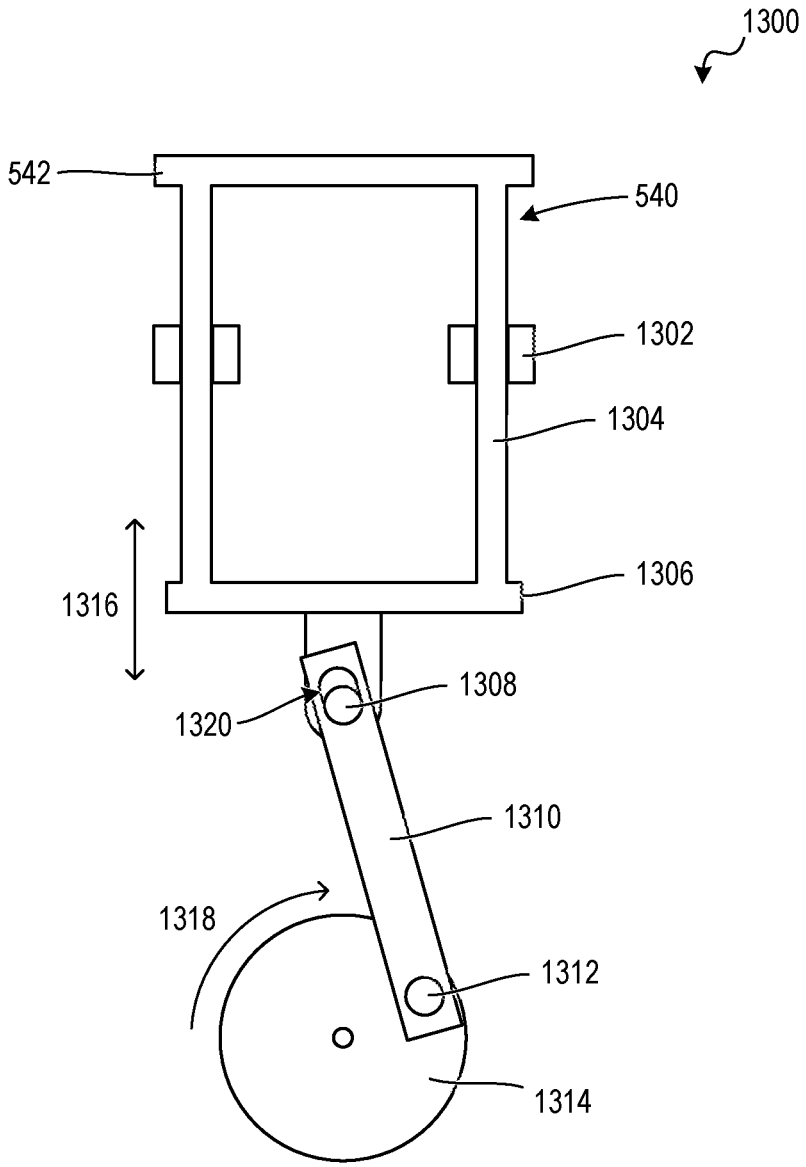
FIG. 13 is a side view of a rotary power output mechanism.

FIG. 13 shows an example power output mechanism 1300 for the apparatus 500 of FIG. 5. The power output mechanism 1300 converts oscillatory motion of the power output component 540 of the apparatus 500 into rotary motion that may be used to turn a mechanical device or operate a generator. The power output mechanism 1300 includes bushings or bearings 1302 through which rods 1304 of the power output component 540 may slide back and forth. A cross-member 1306 attaches the ends of the rods 1304 to a pivot joint 1308. An elongate link-member 1310 connects the pivot joint 1308 to another pivot joint 1312 at the perimeter of a rotatable component 1314, such as a crank arm, gear, or wheel. As the power output component 540 oscillates along axis 1316 due to pressure changes at the cold side 504 of the apparatus 500, the rotatable component 1314 is rotated in direction 1318. The rotatable component 1314 may be connected to a rotary machine or generator to do work or generate electricity. Note that the connection of the link-member 1310 with the pivot joint 1308 at the power output component 540 may include a pin-and-slot connection to prevent premature reversal of rotation and facilitate continuous rotation of the rotatable component 1314.

Figure 14:
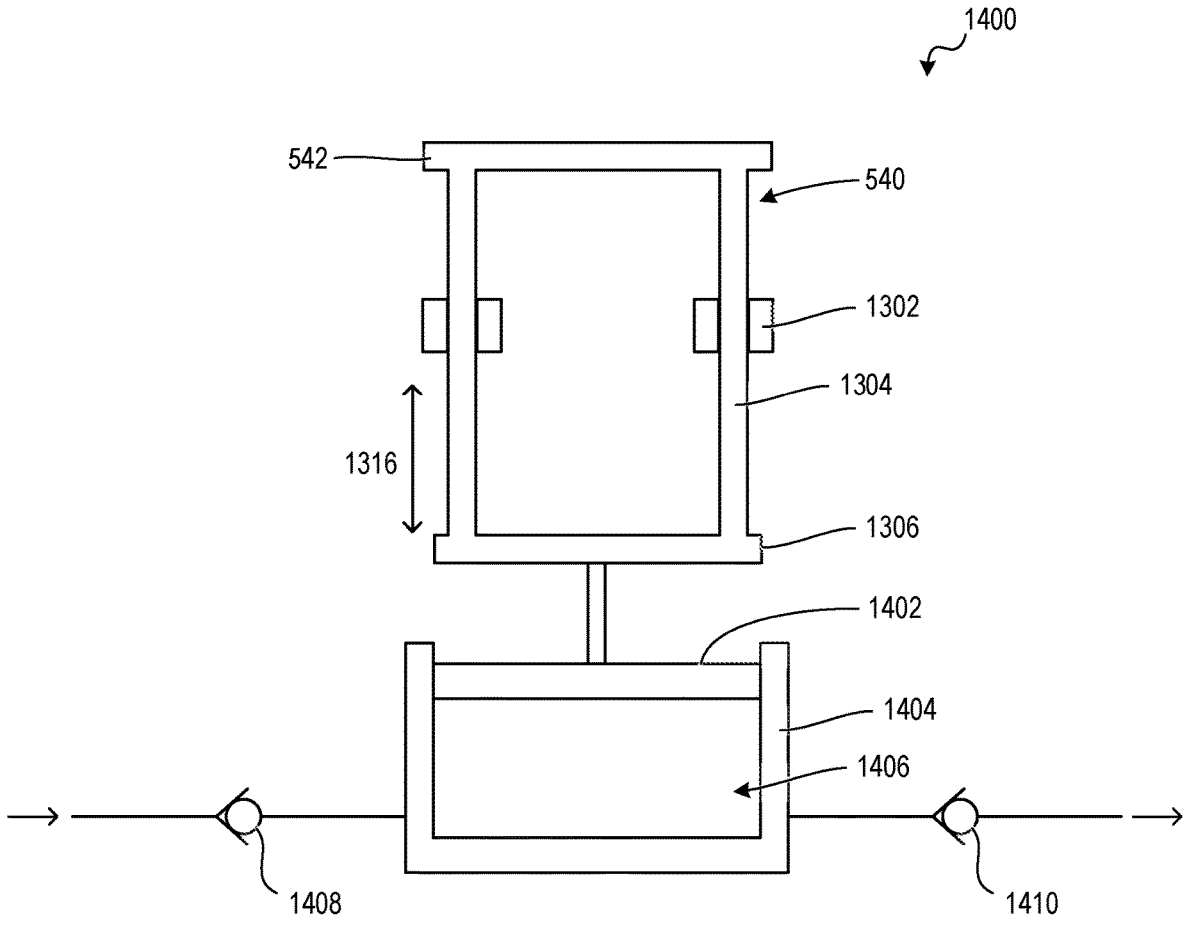
FIG. 14 is a side view of gas-based power output mechanism.

FIG. 14 shows an example gas-based power output mechanism 1400 for the apparatus 500 of FIG. 5. The power output mechanism 1400 converts oscillatory motion of the power output component 540 of the apparatus 500 into gas flow that may drive machinery or create compressed gas. A piston 1402 is connected to the cross-member 1306 of the power output component 540. The piston 1402 is slidable within a cylinder 1404 to compress and expand a volume 1406 internal to the cylinder 1404. An input one-way valve 1408 and an output one-way valve 1410 are provided at respective gas input and output lines of the cylinder 1404 and are aligned in the same direction of flow. When the power output component 540 is moved to cause the piston 1402 to expand the volume 1406, gas is drawn into the cylinder 1404 through the input one-way valve 1408 and gas is prevented from backflowing into the cylinder 1404 by the output one-way valve 1410. When the power output component 540 is moved to cause the piston 1402 to compress the volume 1406, gas is forced out of the cylinder 1404 through the output one-way valve 1410 and gas is prevented from backflowing by the input one-way valve 1418. As such, gas may be flowed to drive a machine or may be compressed.

FIGS. 15A to 15D show various example stages of the apparatus 500 of FIG. 5. For sake of brevity, only several states are shown. FIGS. 4A to 4J may be referenced for further detail in view of the common operating principles of the apparatuses 300 and 500. In addition, FIGS. 15A to 15D generally correspond to the stages discussed with respect to FIGS. 2A to 2D, which may also be referenced for details not repeated here.

Figure 15B:
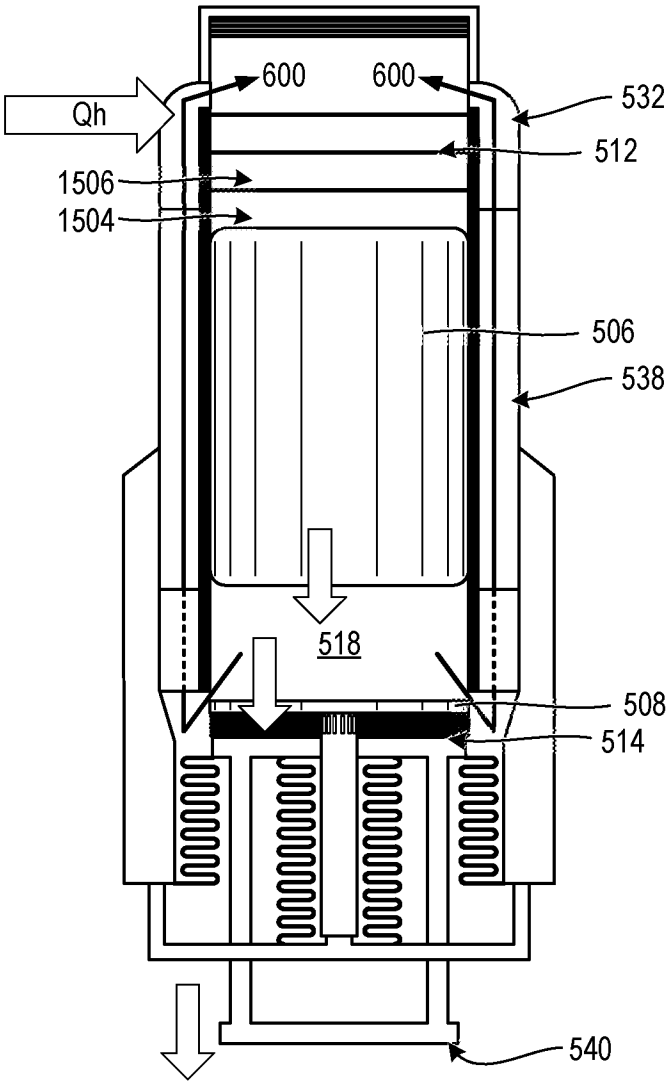
FIG. 15B is a side view of a heating stage of the apparatus of FIG. 5.
Figure 15A:
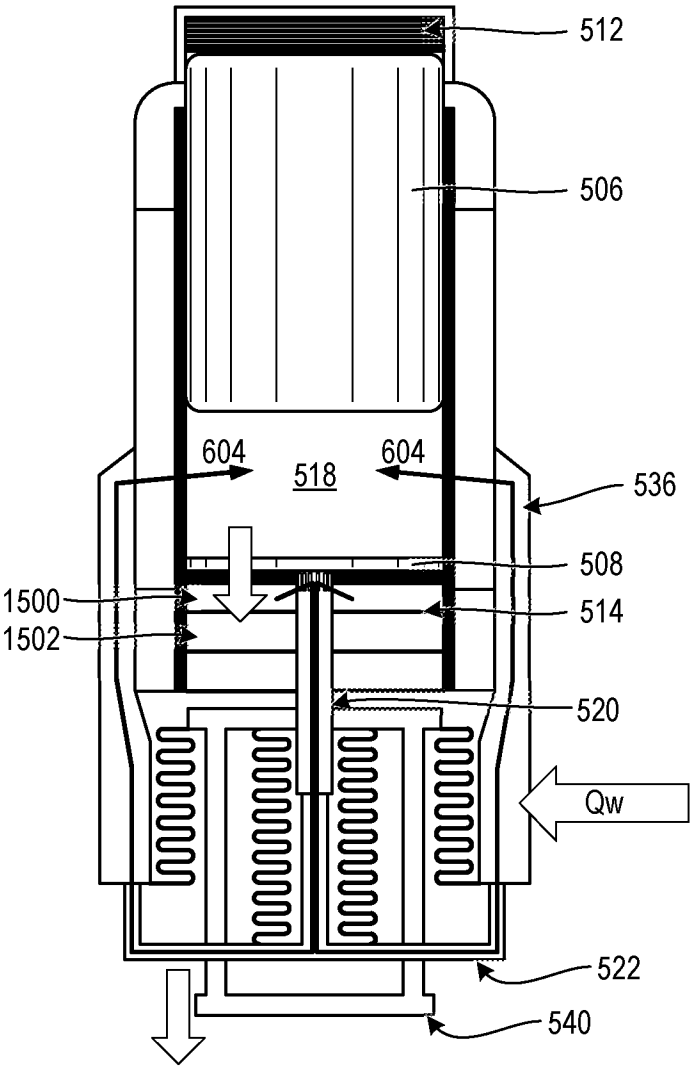
FIG. 15A is a side view of a warming stage of the apparatus of FIG. 5.

FIG. 15A shows a warming stage. The hot-side separators 512 are stowed and the primary displacer 506 is held stationary. The secondary displacer 508 is actuated to force working fluid from the volumes between the cold-side separators 514. The volumes are emptied sequentially. A (first) volume 1500 nearest the secondary displacer 508 is emptied before the next nearest (second) volume 1502, and so on. Working fluid flows along the warming flow path 604, that is, through the telescopic port assembly 520, manifold 522, warming heat exchanger 536, and into the intermediate volume 518. The warming heat exchanger 536 provides warm input Qw from a warming source to the working fluid. In response, the power output component 540 moves downward (i.e., the direction of hot side to cold side) and provides work.

FIG. 15B shows a heating stage. The last of the cold-side separators 514 move into the stowed position. The primary displacer 506 is actuated towards the cold side and the secondary displacer 508 continued to be actuated in the same direction to force warmed working fluid in the intermediate volume 518 and the last of the working fluid from the volumes between the cold-side separators 514 along the heating flow path 600, through the regenerator 538, the hot-side heat exchanger 532 and into volumes between the hot-side separators 512. The volumes are filled sequentially. A (third) volume 1504 nearest the primary displacer 506 is filled before the next nearest (fourth) volume 1506, and so on. The hot-side heat exchanger 532 provides heat input Qh from a heat source to the working fluid. In response, the power output component 540 continues to move downward and provide work. Since pressure is increasing during the heating stage, all volumes contained between the hot-side and cold-side separators may undergo near adiabatic compression.

Figure 15D:
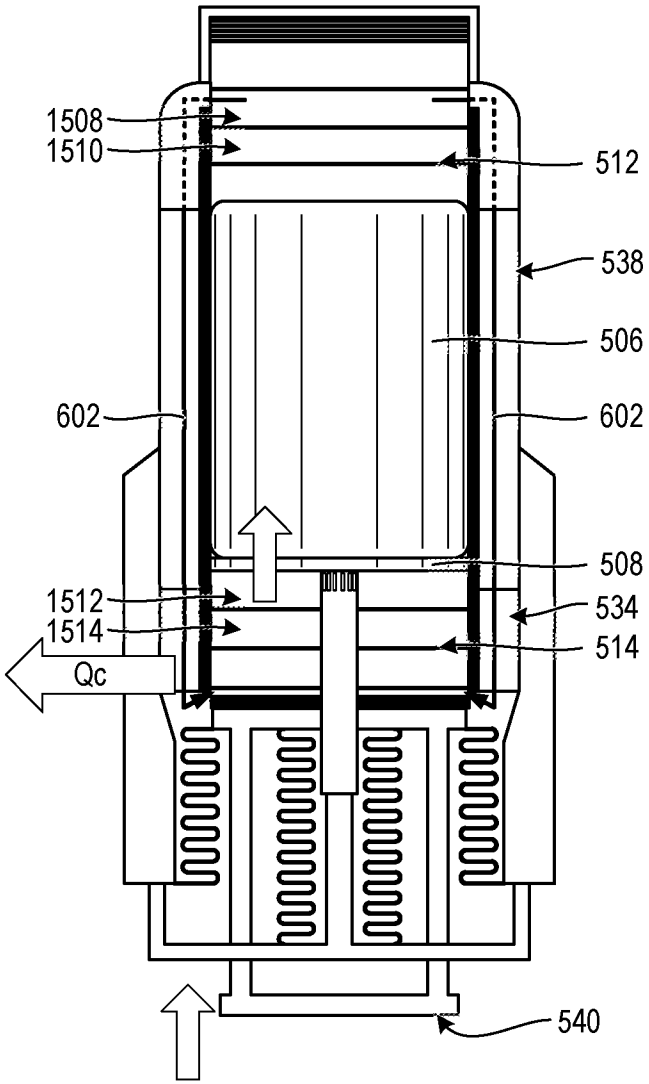
FIG. 15D is a side view of a cooling stage of the apparatus of FIG. 5.
Figure 15C:
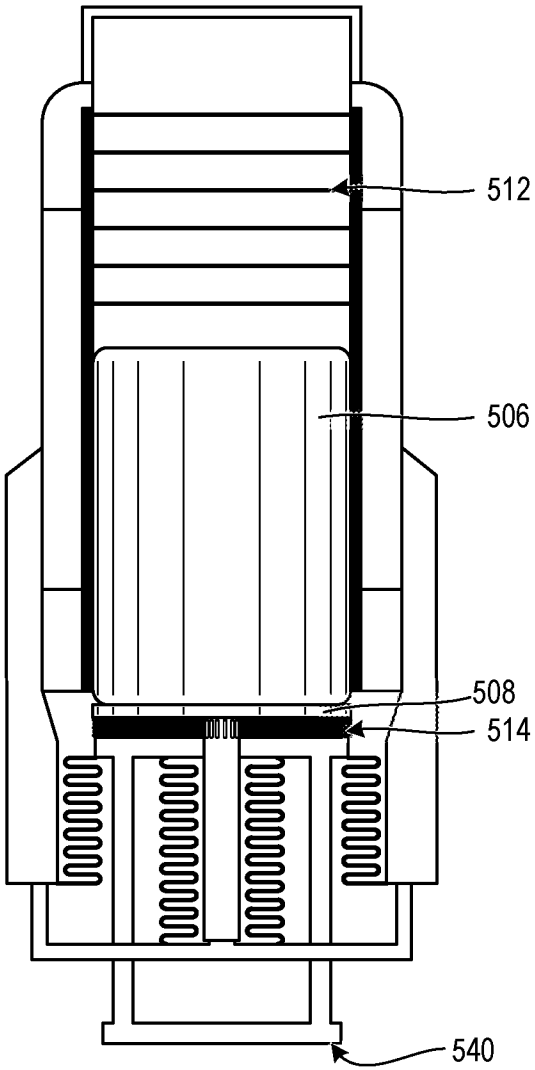
FIG. 15C is a side view of a continued heating stage of the apparatus of FIG. 5.

FIG. 15C shows the heating stage continued and ending at a hot state. The displacers 506, 508 are moved fully toward the cold side (downwards), the hot-side separators 512 are fully deployed with working fluid therebetween, the cold-side separators 514 are fully stowed, intermediate volume 518 is empty, and the power output component 540 reaches the extent of its downward motion.

FIG. 15D shows a cooling stage. The primary and secondary displacers 506, 508 are moved upwards (toward the hot side) in unison and without expanding the intermediate volume 518. Volumes between the hot-side separators 512 are emptied in sequence (opposite the filling sequence), such that a volume 1508 furthest from the primary displacer 506 is emptied before the next volume 1510 that is closer to the primary displacer 506, and so on. Working fluid flows along the cooling flow path 602, through the regenerator 538 and the cold-side heat exchanger 534, and into the volumes between the cold-side separators 514. Volumes between the cold-side separators 514 are filled in sequence (same sequence as the emptying sequence), such that a (first) volume 1512 closest the secondary displacer 508 is filled before the next (second) volume 1514 that is further from the secondary displacer 508, and so on. The cold-side heat exchanger 534 provides heat output Qc to a cold sink to the working fluid. In response, the power output component 540 moves upwards and provides work. Since pressure is decreasing during the cooling stage, all volumes between the hot-side and cold-side separators may undergo near adiabatic expansion.

At the end of the cooling stage, the displacers 506, 508 are moved fully toward the hot side (upwards), the hot-side separators 512 are fully stowed, the cold-side separators 514 are fully deployed with working fluid therebetween, and intermediate volume 518 is empty. The cycle then repeats with the warming stage, as shown in FIG. 15A.

Figure 16A:
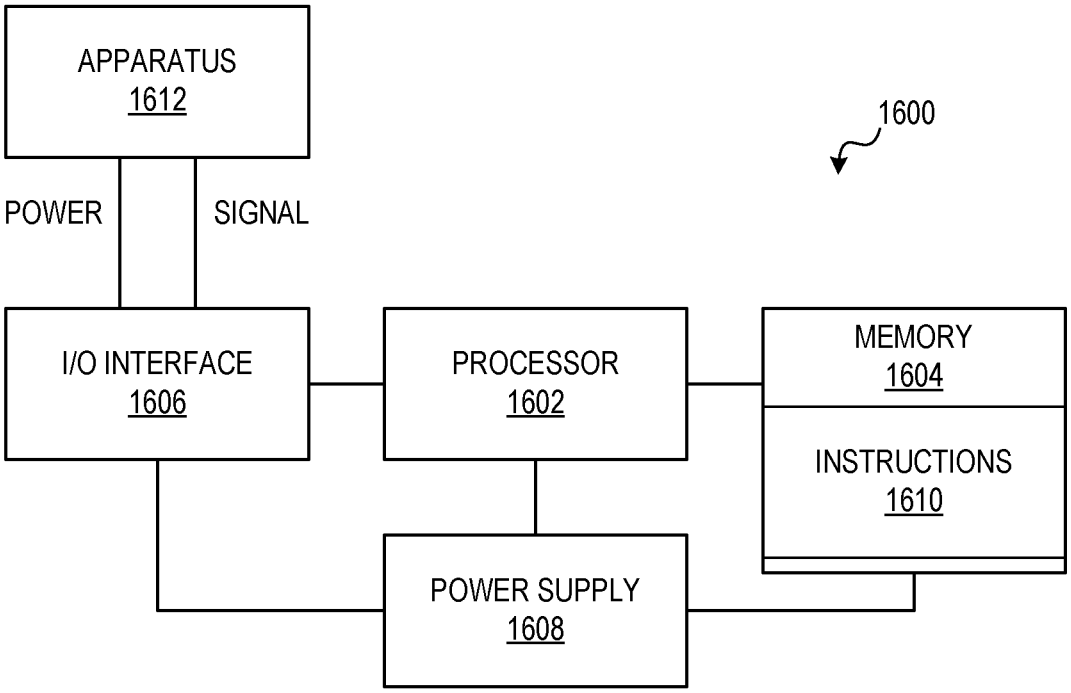
FIG. 16A is a block diagram of a controller to control any of the apparatuses discussed herein.

FIG. 16A shows an example controller 1600 to control any of the apparatuses discussed herein. The controller 1600 includes a processor 1602, a memory 1604 connected to the processor 1602, an input/output (I/O) interface 1606 connected to the processor 1602, and a power supply 1608 to power the processor 1602, memory 1604, and I/O interface 1606.

The processor 1602 may include a central processing unit (CPU), microprocessor, field programmable gate array (FPGA), or application-specific integrated circuit (ASIC)

configurable by hardware, firmware, and/or software into a special-purpose computing device, and may include artificial intelligence algorithms The memory 1604 may include volatile memory, non-volatile memory, or both. The memory 1604 is a non-transitory machine-readable medium that may include an electronic, magnetic, optical, or other type of physical storage device that encodes instructions 1610 that implement functionality discussed herein. Examples of such storage devices include a non-transitory computer-readable medium such as a hard drive (HD), solid-state drive (SSD), read-only memory (ROM), electrically-erasable programmable read-only memory (EEPROM), or flash memory. The memory 1604 may be integrated with the processor 1602. The processor 1602 and memory 1604 may together be integral to an FPGA.

Instructions 1610 may be directly executed, such as binary or machine code, and/or may include interpretable code, bytecode, source code, or similar instructions that may undergo additional processing to be executed. All of such examples may be considered executable instructions.

The I/O interface 1606 connects the processor 1602 to an apparatus 1612, such as the apparatus 100, 300, 500 discussed herein. The I/O interface 1606 may include a general purpose I/O (GPIO) circuit that provides signal communication between the processor 1602 and the apparatus 1612. Example signals include signals from sensors at the apparatus 1612, such as pressure, temperature, and position sensors, and signals to and from actuators at the apparatus 1612. The I/O interface 1606 also connects to the power supply 1608 to provide power to actuators at the apparatus 1612.

Instructions 1610 may implement control methodologies described herein, particularly with regard to control of one or more actuators to move the primary and secondary displacers. The instructions 1610 may also control valves or other flow control elements at the heat exchangers to regulate a rate of heating and/or cooling applied to the working fluid.

Instructions 1610 may implement machine-learning techniques, such as with a neural network or other machine-learning model, to control movement of the primary and secondary displacers and/or to control the heat exchangers. A machine learning model may be trained based on actual operation of an apparatus, as described herein, or based on simulation.

Instructions 1610 may be configured to simultaneously efficiently achieve or exceed the externally requested output of power, cooling, or heating, collectively referred to as demand. The control system would compare the conditions of previous strokes, to learn and execute the best configuration for the next stroke.

Instructions 1610 may increase the ratio of "cooling provided" to "work done" (Rcw) by increasing the back pressure on the pressure plate 542 (FIG. 5), using an external mechanism. Increasing the back pressure on the pressure plate 542, has been analytically shown to increase the slope of the PV curve from 1 to 3 (FIG. 17), thus providing a wide range of Rcw values. For example, if the pressure plate 542 were not permitted to move at all, the back pressure would be maximized, the work output would be zero, the cooling capability of the system would be maximized and Rcw would be infinite. Instructions 1610 may modify other parameters such as the total stroke time and may also independently change the durations of the heating, warming and cooling stages relative to each other in order to effect individual demand. For example, a higher duration warming stage increases Rcw.

Inputs to the control system, in addition to demand requirements, may include values from sensors within the apparatus such as working fluid temperatures and pressures, heat exchanger fluid flows and temperatures and displacer position and velocities. Inputs may also include ambient conditions such as temperatures, pressures, and humidity.

Figure 16B:
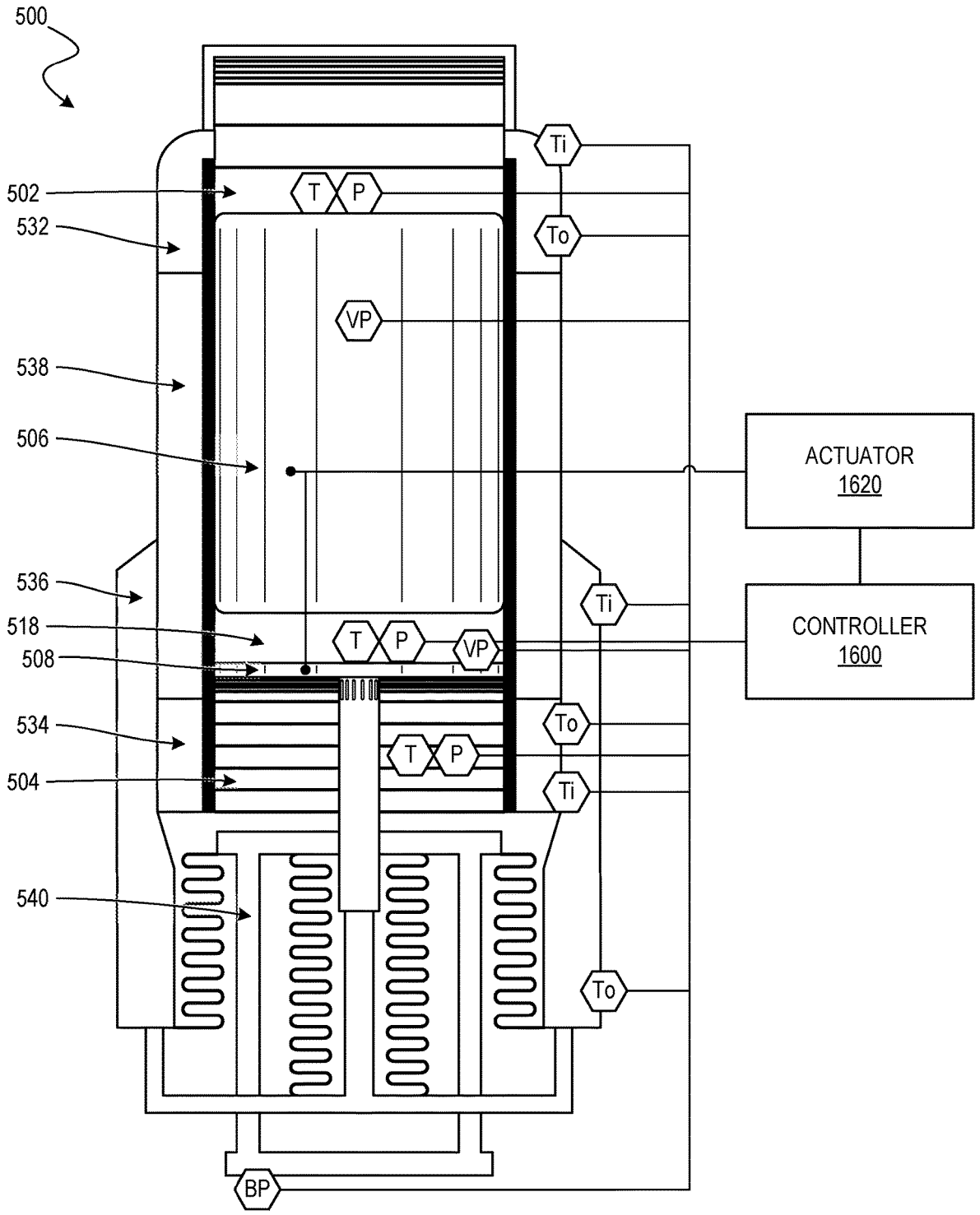
FIG. 16B is a schematic diagram of the controller of FIG. 16A connected to the apparatus of FIG. 5 with sensors and an actuator.

FIG. 16B shows the controller 1600 connected to an apparatus 500 (FIG. 5). The controller 1600 is connected to an actuator 1620 (see actuator 1102 of FIG. 11) that independently drives the primary and secondary displacers 506, 508. The controller 1600 is connected to sensors positioned at the apparatus 500. The sensors shown are examples and more or fewer may be provided in various implementations. Example sensors include temperature sensors T within, entering, and/or leaving the hot side, cold side, and intermediate volume; temperature sensors Ti at respective heat-exchange fluid inputs of the heat exchangers 532, 534, 536; temperature sensors To at respective heat-exchange fluid outputs of the heat exchangers 532, 534, 536; position, velocity, and/or acceleration sensors VP at the primary and secondary displacers 506, 508; and a force sensor (e.g., due to backpressure) BP at the power output component 540.

Figure 17:
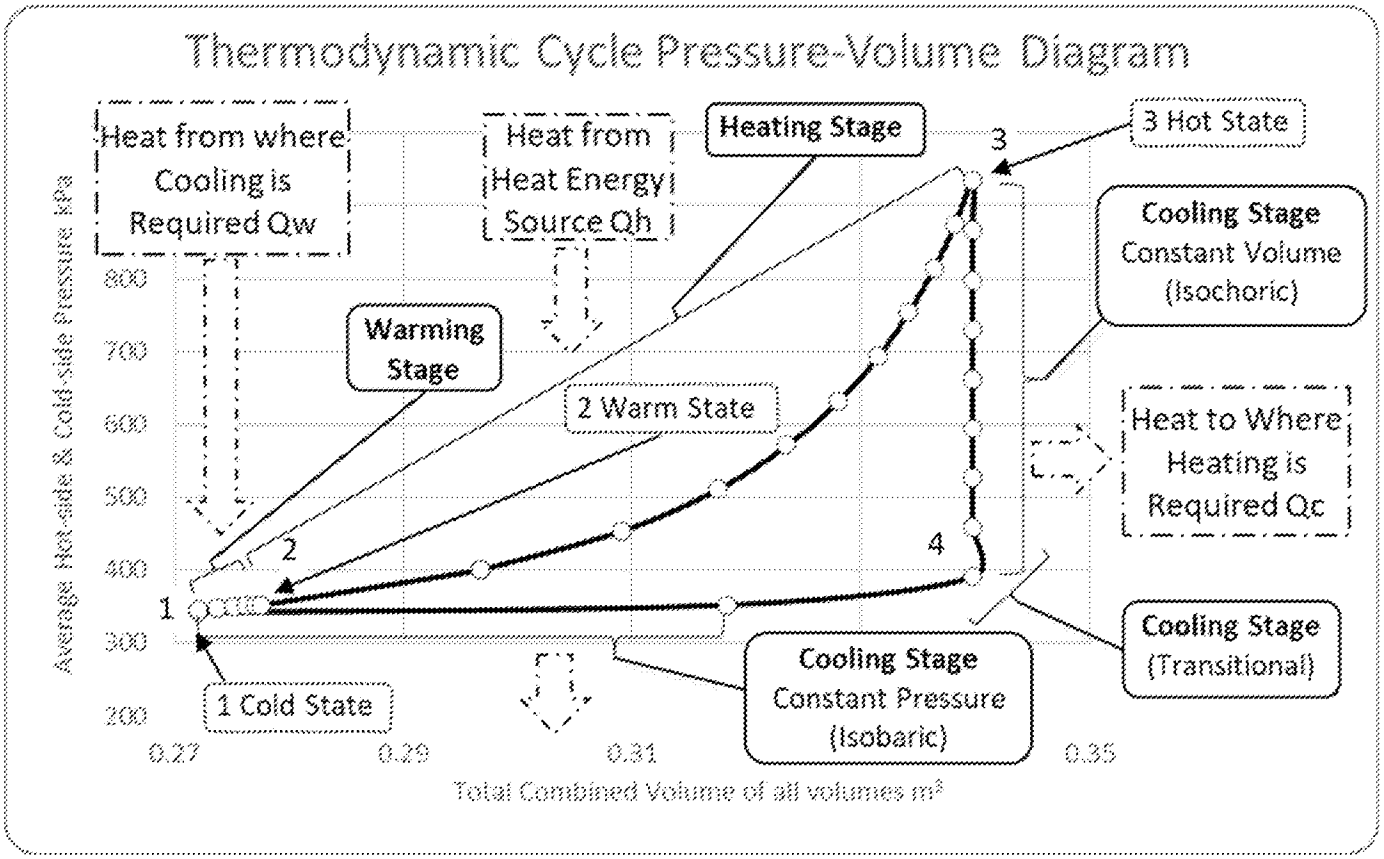
FIG. 17 is pressure-volume diagram of a thermodynamic cycle using any of the apparatuses discussed herein.

FIG. 17 is pressure-volume diagram of a thermodynamic cycle using any of the apparatuses discussed herein, such as the apparatus 500 of FIG. 5 with the power output mechanism 1400 of FIG. 14, to provide heating, cooling and power generation, simultaneously. The diagram is based on an example with analytical predictions using non-reversible thermodynamic cycle conditions. It shows various Stages: warming, heating, and cooling (isochoric, transitional, and isobaric). It shows various States: cold, warm, and hot. It also shows the source and direction of heat flow into and out of the apparatus: Qc, Qh, Qw (see FIG. 1 and related discussion). The volume shown is the combined volume of the hot side, cold side, and warm working fluid volumes.

With reference also to FIG. 14, power is being extracted through the pressure plate 542 of the apparatus 500. The connected piston 1402 is used to compress an external gas in a cylinder 1404. During compression of the cylinder (warming and heating stage of the apparatus 500), the pressure of the gas continues to rise until it is fully compressed (point 3 in FIG. 17) before being pushed out of the cylinder 1404. Once the cylinder 1404 is emptied, the connection to high pressure side of the compression system is blocked via the output one-way valve 1410. The working fluid inside the apparatus 500 begins to cool but initially does not change in volume (i.e., isochoric cooling) since the total force exerted on the pressure plate 542 initially exceeds the total force exerted by the cylinder gas on the piston 1402. When the pressure inside the external cylinder 1404 drops below the pressure of the low-pressure gas (point 4 in FIG. 17), the input one-way valve 1408 begins to open allowing new low-pressure gas to enter the cylinder 1404 at a continuous pressure (i.e., isobaric cooling).

With reference to FIG. 17 and FIG. 4, point 1 indicates what may be termed a cold state of the apparatus 300, as shown in FIG. 4A and described above. Consider an example in which a piston and cylinder filled with a gas is at some external pressure and waiting to be compressed.

From point 1 to point 2 of FIG. 17 is the warming stage of a thermodynamic cycle as shown in FIGS. 4B and 4C. During this stage in this example, low temperature heat is extracted from a location where cooling is required Qw. This is the heat pump effect that provides cooling. Many such applications exist such as the cooling of industrial equipment or the cooling of a building during the summer. In this example, heat may also be extracted by cooling a gas that is to be compressed by the apparatus itself, or by the after cooling of an external gas that has been compressed. Since the volume of the apparatus is increasing in this example, the apparatus can be used to begin the compression of an external gas in a cylinder using a piston, FIG. 14. During this stage, in this example, by causing the external gas to be compressed, the low temperature heat, in addition to providing cooling is simultaneously being used to generate power. Using low temperature heat to produce power while simultaneously cooling is a useful and unique capability.

Point 2 of FIG. 17 is the warm state when warming is completed as shown in FIG. 4D.

From point 2 to point 3 of FIG. 17 is the heating stage. The beginning of the heating stage is shown in FIG. 4E. FIG. 4F shows a view later during the heating stage and FIG. 4G shows a view still later during the heating stage. A high temperature heat source, as described above with respect to FIG. 1, is used as the energy source Qh to drive the apparatus and provide the cooling heat pump effect.

Point 3 of FIG. 17 occurs when the engine is in a hot state as shown in FIG. 4H. At this point the working fluid has reached its maximum pressure, volume, and temperature since all of the volumes are in their heated state. In this state the maximum temperature volume in the hot side may be above the heat source temperature due to near adiabatic compression of the hot gas as the pressure continues to increase. Conversely the volume of the external cylinder, having been reduced by the piston 1402 due to the expansion of the apparatus, would be at its minimum volume but maximum pressure.

Point 3 to 4 of FIG. 17 is the isochoric cooling stage. As the apparatus begins the cooling stage, shown in FIG. 2D, this first part of the cooling stage is isochoric or at constant volume. This may be achieved by placing a hard stop at the piston 1402 when it reaches the minimum volume such as fully emptying the cylinder 1404. Output one-way valve 1410 prevents the displaced gas from re-entering cylinder 1404. The pressure in the cylinder 1404 continues to decrease until it drops to the same pressure as the low-pressure gas inlet. The apparatus will not start to reduce in volume until force exerted on the power output component 540 by the external gas pressure on the piston 1402, plus any compensating force such as a spring, is greater than the force exerted on the power output component 540 from the apparatus 500.

Point 4 of FIG. 17 occurs when the pressure in the cylinder 1404 drops to the pressure of the low-pressure gas inlet. At this point, the force exerted on the power output component by the pressure plate 542 becomes equal to the force exerted by the piston 1402. This allows gas to enter the cylinder 1404 and allows the piston 1402 to move up as the apparatus 500 begins to reduce in volume.

Point 4 to 1 of FIG. 17 the cooling stage continued. At this point the pressure in the apparatus continues to drop due to the cooling of the working gas volumes. When the force caused by the pressure of the working fluid acting on a pressure plate 542 drops below the force caused by the pressure of the external gas acting on the piston 1402, the internal volume of the apparatus 500 will decrease while the volume 1406 of the cylinder 1404 will increase until it reaches its original cycle volume at the cold state point 1.

During the cooling stage, including all stages from point 3 to point 4 and point 4 to point 1, heat may be removed from the apparatus and provided to where heat is required. This could be for heating a building. In such cases it would be considered cogeneration where heat is used to generate power with its excess used to heat a building. In this example, it may be considered "enhanced cogeneration" since it includes heat from the high temperature heat source and from the low temperature heat source. The heat could also be used for many other uses such as heating material as part of an industrial process. A portion of this heat could be returned to the process as part of the low temperature heating between points 1 and 2.

In view of the above, it should be apparent that efficient apparatuses and methods are provided, which may be embodied as heat engines and/or heat pumps. Moveable separators allow for working fluid to undergo near adiabatic expansion and compression, in both the cold and hot side of the apparatus. Two displacers allow for improved control of flow of working fluid, including with a variable intermediate warming volume therebetween.

It should be recognized that features and aspects of the various examples provided above can be combined into further examples that also fall within the scope of the present disclosure. In addition, the figures are not to scale and may have size and shape exaggerated for illustrative purposes.

The invention claimed is:

1. An apparatus comprising:

a vessel to contain a working fluid, the vessel including a hot side to contain heated working fluid and a cold side to contain cooled working fluid, the cold side in fluid communication with the hot side via a hot-cold flow path;

a primary displacer moveably positioned within the vessel, the primary displacer moveable to displace working fluid between the hot side into the cold side via the hot-cold flow path; and a secondary displacer moveably positioned within the vessel between the primary displacer and the cold side, the secondary displacer being independently moveable with respect to movement of the primary displacer to displace working fluid between the cold side and an intermediate volume between the primary displacer and the secondary displacer.

2. The apparatus of claim 1, further comprising:

a controller configured to control motion of the primary displacer and the secondary displacer.

3. The apparatus of claim 2, wherein the controller is configured to:

move the secondary displacer towards the cold side to displace working fluid from the cold side to the intermediate volume;

move the primary displacer towards the cold side to displace working fluid from the intermediate volume, the cold side, or both the intermediate volume and the cold side into the hot side via the hot-cold flow path; and move the primary displacer and the secondary displacer towards the hot side to displace working fluid from the hot side into the cold side via the hot-cold flow path.

4. The apparatus of claim 3, wherein the controller is further configured to:

while moving the primary displacer towards the cold side, move the secondary displacer towards the cold side to displace working fluid from the cold side into the hot side via the hot-cold flow path.

5. The apparatus of claim 3, wherein the controller is further configured to:

while moving the primary displacer towards the cold side, move the secondary displacer towards the cold side to displace working fluid from the cold side into the hot side via the hot-cold flow path; and after fluid is emptied from the cold side, continue to move the primary displacer to displace working fluid from the intermediate volume to the hot side.

6. The apparatus of claim 3, wherein, when the secondary displacer is moved towards the cold side, working fluid is displaced from the cold side into the intermediate volume via a warming flow path.

7. The apparatus of claim 1, further comprising:

a primary actuator connected to the primary displacer to move the primary displacer; and a secondary actuator connected to the secondary displacer to move the secondary displacer.

8. The apparatus of claim 1, further comprising a hot-side heat exchanger at the hot side, the hot-side heat exchanger to heat the working fluid as the working fluid flows into the hot side via the hot-cold flow path.

9. The apparatus of claim 1, further comprising a cold-side heat exchanger at the cold side, the cold-side heat exchanger to cool the working fluid as the working fluid flows into the cold side via the hot-cold flow path.

10. The apparatus of claim 1, further comprising a warming heat exchanger at a warming flow path, the warming heat exchanger to warm the working fluid as the working fluid flows from the cold side to the intermediate volume via the warming flow path.

11. The apparatus of claim 1, further comprising a power output component positioned to form a boundary with the vessel to contain the working fluid, the power output component movable in response to a change in volume of the working fluid.

12. An apparatus comprising:

a vessel to contain a working fluid, the vessel including a hot side to contain heated working fluid and a cold side to contain cooled working fluid;

a primary displacer moveably positioned within the vessel; and a secondary displacer moveably positioned within the vessel between the primary displacer and the cold side;

wherein the primary displacer and the secondary displacer define an intermediate volume therebetween;

wherein a hot-side volume at the hot side, a cold-side volume at the cold side, and the intermediate volume are in fluid communication; and wherein a primary displacer movement and a secondary displacer movement are independent with respect to each other to change the hot-side volume, the cold-side volume, and the intermediate volume to cause the working fluid to flow among the hot-side volume, the cold-side volume, and the intermediate volume.

13. A non-transitory machine-readable medium comprising instructions that, when executed by a processor, cause the processor to:

move a secondary displacer towards a cold side of a vessel to displace working fluid from the cold side to an intermediate volume situated between the secondary displacer and an independently moveable primary displacer;

move the primary displacer towards the cold side to displace working fluid from the intermediate volume, the cold side, or both the intermediate volume and the cold side into a hot side of the vessel via a hot-cold flow path; and move the primary displacer and the secondary displacer towards the hot side to displace working fluid from the hot side into the cold side via the hot-cold flow path.

14. The non-transitory machine-readable medium of claim 13, further comprising instructions that, when executed by a processor, cause the processor to:

while moving the primary displacer towards the cold side, move the secondary displacer towards the cold side to displace working fluid from the cold side into the hot side via the hot-cold flow path.

15. The non-transitory machine-readable medium of claim 13, further comprising instructions that, when executed by a processor, cause the processor to:

while moving the primary displacer towards the cold side, move the secondary displacer towards the cold side to displace working fluid from the cold side into the hot side via the hot-cold flow path; and after fluid is emptied from the cold side, continue to move the primary displacer to displace working fluid from the intermediate volume to the hot side.

16. The non-transitory machine-readable medium of claim 13, wherein the instructions reference a sensor positioned at the vessel to control movement of one or both of the primary displacer and secondary displacer.

17. An apparatus comprising:

a vessel to contain a working fluid, the vessel including a hot side to contain heated working fluid and a cold side to contain cooled working fluid, the cold side in fluid communication with the hot side via a hot-cold flow path;

a primary displacer moveably positioned within the vessel, the primary displacer moveable to displace working fluid between the hot side into the cold side via the hot-cold flow path;

a secondary displacer moveably positioned within the vessel between the primary displacer and the cold side, the secondary displacer moveable with respect to the primary displacer to displace working fluid between the cold side and an intermediate volume between the primary displacer and the secondary displacer;

a primary actuator connected to the primary displacer to move the primary displacer;

a secondary actuator connected to the secondary displacer to move the secondary displacer;

a first actuating rod connecting the primary actuator to the primary displacer; and a second actuating rod connecting the secondary actuator to the secondary displacer, wherein the second actuating rod extends through a bore within the primary displacer.

18. The apparatus of claim 17, wherein:

the first actuating rod extends through the bore within the primary displacer;

the first actuating rod is hollow; and the second actuating rod extends through the first actuating rod.

19. An apparatus comprising:

a vessel to contain a working fluid, the vessel including a hot side to contain heated working fluid and a cold side to contain cooled working fluid, the cold side in fluid communication with the hot side via a hot-cold flow path;

a primary displacer moveably positioned within the vessel, the primary displacer moveable to displace working fluid between the hot side into the cold side via the hot-cold flow path;

a secondary displacer moveably positioned within the vessel between the primary displacer and the cold side, the secondary displacer moveable with respect to the primary displacer to displace working fluid between the cold side and an intermediate volume between the primary displacer and the secondary displacer;

a warming flow path between the cold side and the intermediate volume; and a telescopic port assembly at the warming flow path, wherein the telescopic port assembly is connected to the secondary displacer to allow the secondary displacer to move while maintaining the warming flow path.

20. The apparatus of claim 19, wherein the telescopic port assembly comprises:

a first tube connected to the secondary displacer and movable with the secondary displacer, the first tube including an opening at the cold side; and a second tube in communication with an opening at the intermediate volume;

wherein the first and second tubes are telescopically mated.

21. An apparatus comprising:

a vessel to contain a working fluid, the vessel including a hot side to contain heated working fluid and a cold side to contain cooled working fluid;

a primary displacer moveably positioned within the vessel;

a secondary displacer moveably positioned within the vessel between the primary displacer and the cold side;

a controller configured to control motion of the primary displacer and the secondary displacer; and a power output component positioned to form a boundary with the vessel to contain the working fluid, the power output component movable in response to a change in volume of the working fluid;

wherein the primary displacer and the secondary displacer define an intermediate volume therebetween;

wherein a hot-side volume at the hot side, a cold-side volume at the cold side, and the intermediate volume are in fluid communication;

wherein the primary displacer and the secondary displacer are independently moveable to change the hot-side volume, the cold-side volume, and the intermediate volume to cause the working fluid to flow among the hot-side volume, the cold-side volume, and the intermediate volume.

* * * * *